US010668328B2

(12) United States Patent
Sullivan et al.

(10) Patent No.: US 10,668,328 B2
(45) Date of Patent: Jun. 2, 2020

(54) GOLF BALL HAVING A HOLLOW CENTER

(71) Applicant: Acushnet Company, Fairhaven, MA (US)

(72) Inventors: Michael J. Sullivan, Old Lyme, CT (US); David A. Bulpett, Boston, MA (US); Robert Blink, Newport, RI (US); Mark L. Binette, Mattapoisett, MA (US); Brian Comeau, Berkley, MA (US)

(73) Assignee: Acushnet Company

( * ) Notice: Subject to any disclaimer, the term of this patent is extended or adjusted under 35 U.S.C. 154(b) by 706 days.

(21) Appl. No.: 14/145,633

(22) Filed: Dec. 31, 2013

(65) Prior Publication Data

US 2014/0194227 A1 Jul. 10, 2014

Related U.S. Application Data

(63) Continuation-in-part of application No. 13/736,993, filed on Jan. 9, 2013, and a continuation-in-part of application No. 13/736,997, filed on Jan. 9, 2013, and a continuation-in-part of application No. 13/737,026, filed on Jan. 9, 2013, and a continuation-in-part of application No. 13/737,041, filed on Jan. 9, 2013, now abandoned.

(51) Int. Cl.
*A63B 37/04* (2006.01)
*A63B 37/00* (2006.01)

(52) U.S. Cl.
CPC ..... *A63B 37/0056* (2013.01); *A63B 37/0039* (2013.01); *A63B 37/0041* (2013.01); *A63B 37/0045* (2013.01); *A63B 37/0061* (2013.01); *A63B 37/0062* (2013.01); *A63B 37/0064* (2013.01); *A63B 37/0076* (2013.01); *A63B 37/0077* (2013.01); *A63B 37/0092* (2013.01)

(58) Field of Classification Search
USPC ..... 473/375
See application file for complete search history.

(56) References Cited

U.S. PATENT DOCUMENTS 3,846,509 A * 11/1974 Saluti ..... C08L 33/20 525/309
5,306,760 A 4/1994 Sullivan
5,334,673 A 8/1994 Wu
5,480,155 A 1/1996 Molitor et al.
5,484,870 A 1/1996 Wu
(Continued)

OTHER PUBLICATIONS

DuPont, Hardness Conversion, uploaded Oct. 4, 2016, DuPont, 1 page.*
(Continued)

*Primary Examiner* — Eugene L Kim
*Assistant Examiner* — Matthew B Stanczak
(74) *Attorney, Agent, or Firm* — Mandi B. Milbank

(57) ABSTRACT

Golf balls including a spherical inner core shell layer formed from a thermoset or thermoplastic composition are provided. The shell layer has an outer surface, an inner surface, and an inner diameter to define a hollow center. A thermoset or thermoplastic outer core layer is formed about the shell layer and optional intermediate layer(s) disposed between the shell layer and the outer core layer. A cover is formed about the outer core layer.

3 Claims, 4 Drawing Sheets

(56) References Cited

U.S. PATENT DOCUMENTS 5,589,544 A * 12/1996 Horrion ..... C08J 3/005 525/176
5,777,029 A * 7/1998 Horrion ..... C08L 23/0869 525/119
5,777,033 A * 7/1998 Venkataswamy ..... C08F 8/30 525/182
6,120,390 A * 9/2000 Dalton ..... A63B 37/0003 473/351
6,174,247 B1 * 1/2001 Higuchi ..... A63B 37/0003 473/374
6,315,683 B1 11/2001 Yoshida et al.
6,332,850 B1 * 12/2001 Dalton ..... A63B 37/0003 473/371
6,350,815 B1 * 2/2002 Sullivan ..... A63B 37/0003 525/196
6,455,655 B1 * 9/2002 Colvin ..... C08C 1/14 526/304
6,506,851 B2 1/2003 Wu
6,756,436 B2 6/2004 Rajagopalan et al.
6,815,480 B2 11/2004 Statz et al.
6,835,794 B2 12/2004 Wu et al.
6,953,820 B2 * 10/2005 Statz ..... C08K 5/098 473/372
7,041,721 B2 5/2006 Rajagopalan et al.
7,331,878 B2 2/2008 Boehm et al.
7,365,128 B2 4/2008 Sullivan
7,537,529 B2 5/2009 Bulpett et al.
7,537,530 B2 5/2009 Bulpett et al.
7,591,742 B2 9/2009 Sullivan et al.
7,612,134 B2 11/2009 Kennedy, III et al.
7,612,135 B2 * 11/2009 Kennedy, III ..... C08L 23/0815 473/385
7,642,319 B2 1/2010 Sullivan et al.
8,163,823 B2 4/2012 Sullivan et al.
8,262,508 B2 * 9/2012 Nakamura ..... A63B 37/0038 473/351
8,265,508 B2 9/2012 Nakamura et al.
2004/0092335 A1 * 5/2004 Boehm ..... A63B 37/0003 473/354
2004/0235587 A1 * 11/2004 Sullivan ..... A63B 37/12 473/371
2005/0234207 A1 * 10/2005 Moutinho ..... C08F 2/22 526/319
2006/0211518 A1 * 9/2006 Sullivan ..... C08L 23/08 473/373
2008/0220903 A1 * 9/2008 Sullivan ..... A63B 37/0003 473/376
2008/0227568 A1 * 9/2008 Sullivan ..... A63B 37/0003 473/376
2008/0234068 A1 * 9/2008 Comeau ..... A63B 37/0003 473/377
2008/0234070 A1 * 9/2008 Comeau ..... A63B 37/0024 473/378
2008/0242448 A1 * 10/2008 Sullivan ..... A63B 37/0003 473/376
2008/0318711 A1 * 12/2008 Dalton ..... A63B 37/0003 473/376
2009/0005194 A1 * 1/2009 Dalton ..... A63B 37/0003 473/374
2009/0017940 A1 * 1/2009 Sullivan ..... A63B 37/0003 473/374
2009/0197704 A1 * 8/2009 Sullivan ..... A63B 37/0003 473/376
2009/0203469 A1 8/2009 Sullivan
2009/0305816 A1 * 12/2009 Morgan ..... A63B 37/0003 473/354
2010/0056301 A1 * 3/2010 Nakamura ..... A63B 37/0038 473/375
2010/0151969 A1 * 6/2010 Sullivan ..... A63B 37/0023 473/378
2012/0052981 A1 * 3/2012 Nanba ..... A63B 37/0047 473/371
2014/0194222 A1 7/2014 Sullivan et al.
2014/0194223 A1 7/2014 Sullivan et al.
2014/0194224 A1 7/2014 Sullivan et al.
2014/0194225 A1 7/2014 Sullivan et al.

OTHER PUBLICATIONS

Rick White, Shore Durometer Conversion Chart, uploaded Oct. 4, 2016, Thermal Tech Equipment, 1 page.*

* cited by examiner

GOLF BALL HAVING A HOLLOW CENTER

CROSS-REFERENCE TO RELATED APPLICATIONS

This application is a continuation-in-part of U.S. patent application Ser. No. 13/736,993, filed Jan. 9, 2013; U.S. patent application Ser. No. 13/736,997, filed Jan. 9, 2013; U.S. patent application Ser. No. 13/737,026, filed Jan. 9, 2013; and U.S. patent application Ser. No. 13/737,041, filed Jan. 9, 2013; the entire disclosures of which are hereby incorporated herein by reference.

FIELD OF THE INVENTION

This invention relates generally to golf balls with a core having a hollow center surrounded by one or more core layers and one or more cover layers. Any of the core or cover layers may have a 'negative' or 'positive' hardness gradient, depending on the desired construction.

BACKGROUND OF THE INVENTION

In recent years, virtually all golf balls are of a solid construction, typically including with a solid core encased by a cover, both of which can have multiple layers, such as a dual core having a solid center and an outer core layer, or a multi-layer cover having an inner and outer cover layer. Golf ball cores and/or centers are formed from a thermoset rubber composition with polybutadiene as the base rubber. The cores are usually heated and crosslinked to create a core having certain pre-determined characteristics, such as compression or hardness, which result in a golf ball having the properties for a particular group of players, whether it be professionals, low-handicap players, or mid-to-high handicap golfers. From the perspective of a golf ball manufacturer, it is desirable to have cores exhibiting a wide range of properties, such as resilience, durability, spin, and "feel," because this enables the manufacturer to make and sell golf balls suited to differing levels of ability.

There remains a need, however, for golf ball constructions that allow differing properties to be achieved. One such novel construction with no past commercial success is a golf ball having a hollow core—meaning the innermost portion of the core is hollow surrounded by a 'shell layer' and one or more core and cover layers. While, in the past, many commercially-available golf balls have been constructed with non-solid centers, such as liquid centers, very few golf balls having hollow centers have ever been constructed.

While the patent literature references, mostly in a cursory manner, a hollow core as a suitable general alternative construction, very few are actually directed to a hollow core golf ball. For example, U.S. Pat. No. 6,315,683 is generally directed to an over-sized (greater than 1.70 inches) hollow solid golf ball where the hollow core is contained in a thermoset rubber layer and covered with a single ionomer cover. More recently, U.S. Pat. No. 8,262,508 generally describes a golf ball having a hollow center, a mid-layer, an inner cover, and an outer cover. The hollow center and mid-layer are both formed from a thermoset rubber composition, and a conventional 'positive hardness gradient' (layer hardness gets softer in the direction of the interior of the layer). The hollow 'space' has a diameter of 0.08 to 0.5 inches and the core layer has a low surface hardness of 25 to 55 Shore C. The golf ball is covered by a harder ionomer outer cover and a softer ionomer inner cover.

SUMMARY OF THE INVENTION

The present invention is directed to a golf ball comprising a core and a cover. The core comprises a spherical inner core shell layer having an outer surface, an inner surface, and an inner diameter to define a hollow center, an outer core layer, and optionally an intermediate layer disposed between the shell layer and the outer core layer. At least one of the core layers is formed from a highly neutralized polymer composition comprising an acid copolymer of ethylene and an α,β-unsaturated carboxylic acid, optionally including a softening monomer selected from the group consisting of alkyl acrylates and methacrylates; a non-acid polymer selected from the group consisting of polyolefins, polyamides, polyesters, polyethers, polyurethanes, metallocene-catalyzed polymers, single-site catalyst polymerized polymers, ethylene propylene rubber, ethylene propylene diene rubber, styrenic block copolymer rubbers, alkyl acrylate rubbers, and functionalized derivatives thereof; an organic acid or salt thereof; and a cation source present in an amount sufficient to neutralize greater than 80% of all acid groups present in the composition.

In one embodiment, the shell layer is formed from a thermoset rubber composition, the outer core layer is formed from a first thermoplastic composition, and the optional intermediate core layer, if present, is formed from a second thermoplastic composition. At least one of the first thermoplastic composition and the second thermoplastic composition is the highly neutralized acid polymer composition comprising the acid polymer, non-acid polymer, organic acid or salt thereof, and cation source. The hollow center has a diameter of from 0.15 inches to 1.1 inches and the difference in Shore C surface hardness between the outer surface of the shell layer and the inner surface of the shell layer is from 3 Shore C to 25 Shore C.

In another embodiment, the shell layer is formed from a first thermoset rubber composition, the outer core layer is formed from a thermoplastic composition, and the optional intermediate core layer, if present, is formed from a second thermoset composition. The outer core layer composition is the highly neutralized acid polymer composition comprising the acid polymer, non-acid polymer, organic acid or salt thereof, and cation source. The hollow center has a diameter of from 0.15 inches to 1.1 inches and the difference in Shore C surface hardness between the outer surface of the shell layer and the inner surface of the shell layer is from 3 Shore C to 25 Shore C.

In another embodiment, the shell layer is formed from a thermoplastic composition, the outer core layer is formed from a first thermoset composition, and the optional intermediate core layer, if present, is formed from a second thermoset composition. The shell layer composition is the highly neutralized acid polymer composition comprising the acid polymer, non-acid polymer, organic acid or salt thereof, and cation source. The hollow center has a diameter of from 0.15 inches to 1.1 inches and the difference in Shore C surface hardness between the outer surface of the shell layer and the inner surface of the shell layer is from 0 Shore C to 5 Shore C.

In another embodiment, the shell layer is formed from a first thermoplastic composition, the outer core layer is formed from a thermoset composition, and the optional intermediate core layer, if present, is formed from a second thermoplastic composition. At least one of the first thermoplastic composition and the second thermoplastic composition is the highly neutralized acid polymer composition comprising the acid polymer, non-acid polymer, organic acid or salt thereof, and cation source. The hollow center has a diameter of from 0.15 inches to 1.1 inches and the difference in Shore C surface hardness between the outer surface of the shell layer and the inner surface of the shell layer is from 0 Shore C to 5 Shore C.

In another embodiment, the shell layer is formed from a first thermoplastic composition, the outer core layer is formed from a second thermoplastic composition, and the optional intermediate core layer, if present, is formed from a third thermoplastic composition. At least one of the first thermoplastic composition, the second thermoplastic composition, and the third thermoplastic composition is the highly neutralized acid polymer composition comprising the acid polymer, non-acid polymer, organic acid or salt thereof, and cation source. The hollow center has a diameter of from 0.15 inches to 1.1 inches and the difference in Shore C surface hardness between the outer surface of the shell layer and the inner surface of the shell layer is from 0 Shore C to 5 Shore C.

In another embodiment, the shell layer is formed from a first thermoplastic composition, the outer core layer is formed from a second thermoplastic composition, and the optional intermediate core layer, if present, is formed from a thermoset composition. At least one of the first thermoplastic composition and the second thermoplastic composition is the highly neutralized acid polymer composition comprising the acid polymer, non-acid polymer, organic acid or salt thereof, and cation source. The hollow center has a diameter of from 0.15 inches to 1.1 inches and the difference in Shore C surface hardness between the outer surface of the shell layer and the inner surface of the shell layer is from 0 Shore C to 5 Shore C.

In another embodiment, the shell layer is formed from a first thermoset rubber composition, the outer core layer is formed from a second thermoset composition, and at least one intermediate core layer formed from a thermoplastic composition is disposed between the shell layer and the outer core layer. The intermediate core layer composition is the highly neutralized acid polymer composition comprising the acid polymer, non-acid polymer, organic acid or salt thereof, and cation source. The hollow center has a diameter of from 0.15 inches to 1.1 inches and the difference in Shore C surface hardness between the outer surface of the shell layer and the inner surface of the shell layer is from 10 Shore C to 25 Shore C.

In the above embodiments, the highly neutralized composition comprising an acid copolymer, a non-acid polymer, an organic acid or salt thereof, and a cation source optionally has one or more of the following properties:

(a) the acid copolymer does not include a softening monomer;
(b) the acid of the acid copolymer is selected from acrylic acid and methacrylic acid;
(c) the acid of the acid copolymer is present in the acid copolymer in an amount of from 15 mol % to 30 mol %, based on the total weight of the acid copolymer;
(d) the non-acid polymer is an alkyl acrylate rubber selected from ethylene-alkyl acrylates and ethylene-alkyl methacrylates;
(e) the non-acid polymer is present in an amount of greater than 50 wt %, based on the combined weight of the acid copolymer and the non-acid polymer;
(f) the non-acid polymer is present in an amount of 20 wt % or greater, based on the total weight of the highly neutralized composition;
(g) the non-acid polymer is present in an amount of less than 50 wt %, based on the combined weight of the acid copolymer and the non-acid polymer;
(h) the highly neutralized polymer composition has a solid sphere compression of 40 or less and a coefficient of restitution of 0.820 or greater;
(i) the highly neutralized polymer composition has a solid sphere compression of 100 or greater and a coefficient of restitution of 0.860 or greater;
(j) the organic acid salt is a metal salt of oleic acid;
(k) the organic salt is magnesium oleate;
(l) the organic salt is present in an amount of 30 parts or greater, per 100 parts of acid copolymer and non-acid copolymer combined; and
(m) the cation source is present in an amount sufficient to neutralize 110% or greater of all acid groups present in the composition.

DETAILED DESCRIPTION OF THE INVENTION

Figure 4:
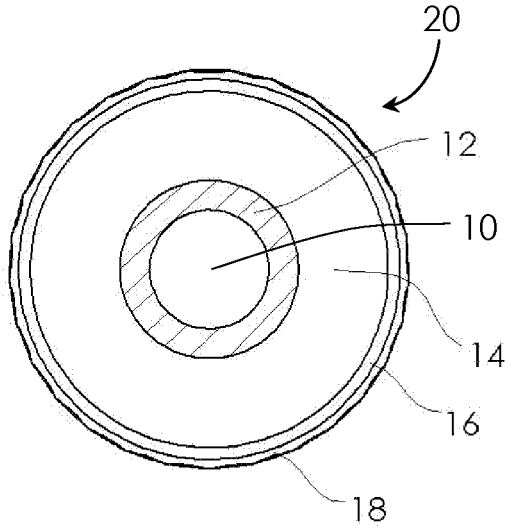
FIG. 4 is a cross-sectional view of a golf ball according to one embodiment of the present invention.

FIG. 4 shows a golf ball 20 according to one embodiment of the present invention, including a hollow interior portion 10, a spherical shell layer 12, and optional intermediate core layer 14, and outer core layer 16, and a cover 18. While shown in FIG. 4 as a single layer, cover 18 may be a single-, dual-, or multi-layer cover.

The golf balls of the present invention may include multi-layer golf balls, such as one having a core and a cover surrounding the core, but are preferably formed from a core having a hollow core and at least one outer core layer, an inner cover layer, and an outer cover layer. Any of the core or cover layers may include more than one layer. The cover layer of the golf ball may be a single layer or formed of a plurality of layers, such as an inner cover layer and an outer cover layer.

In one embodiment, the hollow core is formed of a thermoset 'shell layer' that contains a spherical hollow portion in its interior. In a particular aspect of this embodiment, the golf ball includes the thermoset hollow core and at least two outer core layers, where the shell layer is formed from a thermoset material, an outer core layer is formed from a thermoplastic material, and an intermediate core layer, disposed between the shell layer and the outer core layer, is formed from a thermoplastic material. In another particular aspect of this embodiment, the golf ball includes the thermoset hollow core and at least two outer core layers, where the shell layer is formed from a thermoset material, an outer core layer is formed from a thermoplastic material, and an intermediate core layer, disposed between the shell layer and the outer core layer, is formed from a thermoset material. In another particular aspect of this embodiment, the golf ball includes the thermoset hollow core and at least two outer core layers, where the shell layer is formed from a thermoset material, an outer core layer is formed from a thermoset material, and an intermediate core layer, disposed between the shell layer and the outer core layer, is formed from a thermoplastic material. In another particular aspect of this embodiment, the golf ball includes the thermoset hollow core and at least two outer core layers, where the shell layer is formed from a thermoset material, an outer core layer is formed from a thermoset material, and an intermediate core layer, disposed between the shell layer and the outer core layer, is formed from a thermoset material.

In another embodiment, the hollow core is formed of a thermoplastic 'shell layer' that contains a spherical hollow portion in its interior. In a particular aspect of this embodiment, the golf ball includes the thermoplastic hollow core and at least two outer core layers, where the shell layer is formed from a thermoplastic material, an outer core layer is formed from a thermoset material, and an intermediate core layer, disposed between the shell layer and the outer core layer, is formed from a thermoset material. In another particular aspect of this embodiment, the golf ball includes the thermoplastic hollow core and at least two outer core layers, where the shell layer is formed from a thermoplastic material, an outer core layer is formed from a thermoset material, and an intermediate core layer, disposed between the shell layer and the outer core layer, is formed from a thermoplastic material. In another particular aspect of this embodiment, the golf ball includes the thermoplastic hollow core and at least two outer core layers, where the shell layer is formed from a thermoplastic material, an outer core layer is formed from a thermoplastic material, and an intermediate core layer, disposed between the shell layer and the outer core layer, is formed from a thermoset material. In another particular embodiment, the golf ball includes the thermoplastic hollow core and at least two outer core layers, where the shell layer is formed from a thermoplastic material, an outer core layer is formed from a thermoplastic material, and an intermediate core layer, disposed between the shell layer and the outer core layer, is formed from a thermoplastic material.

The shell, outer core, or intermediate core layers may have either a conventional "hard-to-soft" hardness gradient (i.e., the outermost surface/portion of the layer is harder than the innermost surface/portion), known as a "positive hardness gradient," or a "soft-to-hard" hardness gradient (i.e., a "negative" hardness gradient) as measured radially-inward from the outer surface or portion of each component towards the innermost portion (i.e., from the outer surface/portion towards the inner surface/portion of the shell and/or core layers). As used herein, the terms "negative" and "positive," with respect to hardness gradient, refer to the result of subtracting the hardness value at the innermost portion of the component being measured (e.g., the inner surface of a core layer) from the hardness value at the outer surface of the component being measured (e.g., the outer surface of an outer core layer). For example, if the outer surface of a core layer has a lower hardness value than at the inner surface, the hardness gradient will be deemed a "negative" gradient (a smaller number−a larger number=a negative number), although the magnitude may be disclosed in the application as the absolute value of the subtraction result in combination with the designation 'negative').

The thermoplastic shell, intermediate core layers, and outer core layers of the invention may have 'positive hardness gradients' or 'negative hardness gradients', as described above. Alternatively, the TP layers may have a 'zero hardness gradient', defined herein to include a 0 Shore C hardness gradient ±2 Shore C. The TP layer 'positive hardness gradient' or 'negative hardness gradient' may be from about 0 Shore C to about 10 Shore C, more preferably about 2 Shore C to about 8 Shore C, and most preferably about 3 Shore C to about 5 Shore C.

The thermoset shell, intermediate core layers, and outer core layers of the invention may have 'positive hardness gradients' or 'negative hardness gradients', as described above. Alternatively, the TS layers may have a 'zero hardness gradient', defined herein to include a 0 Shore C hardness gradient ±2 Shore C. The TS layer 'positive hardness gradient' or 'negative hardness gradient' may be from about 1 Shore C to about 30 Shore C, preferably about 2 Shore C to about 27 Shore C, more preferably about 5 Shore C to about 25 Shore C, and most preferably about 10 to 20 Shore C. Other suitable TS 'positive hardness gradient' or 'negative hardness gradient' core layers can be found in U.S. Pat. Nos. 7,537,529 and 7,537,530, the disclosures of which are incorporated herein, in their entirety, by reference thereto.

A variety of the above TS and TP hardness gradient layers are envisioned and both 'positive hardness gradients' and/or 'negative hardness gradients' may be combined to form the hollow cores of the invention having various layers of this nature.

The surface hardness of the shell or core layers is obtained from the average of a number of measurements taken from opposing hemispheres of the particular layer, taking care to avoid making measurements on the parting line or any surface defects, such as holes or protrusions. Hardness measurements are made pursuant to ASTM D-2240 "Indentation Hardness of Rubber and Plastic by Means of a Durometer." Because of the curved surface of the hollow core or core layers, care must be taken to insure that they are centered under the durometer indentor before a surface hardness reading is obtained. A calibrated, digital durometer, capable of reading to 0.1 hardness units is used for all hardness measurements and is set to take hardness readings 1 second after the maximum reading is obtained. The digital durometer must be attached to, and its foot made parallel to, the base of an automatic stand, such that the weight on the durometer and attack rate conform to ASTM D-2240.

To prepare the hollow core for hardness and hardness gradient measurements, the core (shell layer or with one or two core layers) is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90° to this orientation prior to securing. A measurement is also made from the bottom of the holder to the top of the core to provide a reference point for future calculations. A rough cut, made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' core surface is ground to a smooth, flat surface, revealing the hollow center of the core, which can be verified by measuring the height of the bottom of the holder to the exposed surface of the core, making sure that exactly half of the original height of the core, as measured above, has been removed to within ±0.004 inches.

Leaving the core in the holder, the center of the core is found with a center square and carefully marked and the hardness is measured at the center mark. Hardness measurements at any distance from the center of the core may be measured by drawing a line radially outward from the center mark, and measuring and marking the distance from the center, typically in 1- or 2-mm increments. All hardness measurements performed on the plane passing through the hollow center are performed while the core is still in the holder and without having disturbed its orientation, such that the test surface is constantly parallel to the bottom of the holder. The hardness difference from any predetermined location on the core is calculated as the average surface hardness minus the hardness at the appropriate reference point.

One or more of the shell layer and/or core layers may be formed from a composition including at least one thermoset base rubber, such as a polybutadiene rubber, cured with at least one peroxide and at least one reactive co-agent, which can be a metal salt of an unsaturated carboxylic acid, such as acrylic acid or methacrylic acid, a non-metallic coagent, or mixtures thereof. Preferably, a suitable antioxidant is included in the composition. An optional 'soft and fast agent' (sometimes called a cis-to-trans catalyst), such as an organosulfur or metal-containing organosulfur or thiol compound, can also be included in the core formulation. Other ingredients that are known to those skilled in the art may be used, and are understood to include, but not be limited to, density-adjusting fillers, process aides, plasticizers, blowing or foaming agents, sulfur accelerators, and/or non-peroxide radical sources.

The base thermoset rubber, which can be blended with other rubbers and polymers, typically includes a natural or synthetic rubber. A preferred base rubber is 1,4-polybutadiene having a cis structure of at least 40%, preferably greater than 80%, and more preferably greater than 90%.

Examples of desirable polybutadiene rubbers include BUNA® CB22 and BUNA®CB23, CB1221, CB1220, CB24, and CB21, commercially-available from LANXESS Corporation; UBEPOL® 360L and UBEPOL® 150L and UBEPOL-BR rubbers, commercially available from UBE Industries, Ltd. of Tokyo, Japan; KINEX® 7245, KINEX® 7265, and BUDENE 1207 and 1208, commercially available from Goodyear of Akron, Ohio; SE BR-1220; Europrene® NEOCIS® BR 40 and BR 60, commercially available from Polimeri Europa; and BR 01, BR 730, BR 735, BR 11, and BR 51, commercially available from Japan Synthetic Rubber Co., Ltd; PETROFLEX® BRNd-40; and KARBOCHEM® ND40, ND45, and ND60, commercially available from Karbochem.

From the Lanxess Corporation, most preferred are the Nd- and Co-catalyzed grades, but all of the following may be used: BUNA CB 21; BUNA CB 22; BUNA CB 23; BUNA CB 24; BUNA CB 25; BUNA CB 29 MES; BUNA CB Nd 40; BUNA CB Nd 40 H; BUNA CB Nd 60; BUNA CB 55 NF; BUNA CB 60; BUNA CB 45 B; BUNA CB 55 B; BUNA CB 55 H; BUNA CB 55 L; BUNA CB 70 B; BUNA CB 1220; BUNA CB 1221; BUNA CB 1203; BUNA CB 45. Additionally, numerous suitable rubbers are available from JSR (Japan Synthetic Rubber), UBEPOL sold by Ube Industries Inc, Japan, BST sold by BST Elastomers, Thailand; IPCL sold by Indian Petrochemicals Ltd, India; NITSU sold by Karbochem or Karbochem Ltd of South Africa; PETROFLEX of Brazil; LG of Korea; and Kuhmo Petrochemical of Korea.

The base rubber may also comprise high or medium Mooney viscosity rubber, or blends thereof. A "Mooney" unit is a unit used to measure the plasticity of raw or unvulcanized rubber and is defined according to ASTM D-1646. The Mooney viscosity range is preferably greater than about 40, more preferably in the range from about 40 to 60 and most preferably in the range from about 40 to 52.

Commercial sources of suitable polybutadienes include Bayer AG CB23 (Nd-catalyzed), which has a Mooney viscosity of around 50 and is a highly linear polybutadiene, and CB1221 (Co-catalyzed). If desired, the polybutadiene can also be mixed with other elastomers known in the art, such as other polybutadiene rubbers, natural rubber, styrene butadiene rubber, and/or isoprene rubber in order to further modify the properties of the core. When a mixture of elastomers is used, the amounts of other constituents in the core composition are typically based on 100 parts by weight of the total elastomer mixture.

In one preferred embodiment, the base rubber comprises a Nd-catalyzed polybutadiene, a rare earth-catalyzed polybutadiene rubber, or blends thereof. If desired, the polybutadiene can also be mixed with other elastomers known in the art such as natural rubber, polyisoprene rubber and/or styrene-butadiene rubber in order to modify the properties of the core. Other suitable base rubbers include thermosetting materials such as, ethylene propylene diene monomer rubber, ethylene propylene rubber, butyl rubber, halobutyl rubber, hydrogenated nitrile butadiene rubber, nitrile rubber, and silicone rubber.

Suitable peroxide initiating agents include dicumyl peroxide; 2,5-dimethyl-2,5-di(t-butylperoxy) hexane; 2,5-dimethyl-2,5-di(t-butylperoxy)hexyne; 2,5-dimethyl-2,5-di (benzoylperoxy)hexane; 2,2'-bis(t-butylperoxy)-di-isopropylbenzene; 1,1-bis(t-butylperoxy)-3,3,5-trimethyl cyclohexane; n-butyl 4,4-bis(t-butyl-peroxy)valerate; t-butyl perbenzoate; benzoyl peroxide; n-butyl 4,4'-bis(butylperoxy) valerate; di-t-butyl peroxide; or 2,5-di-(t-butylperoxy)-2,5-dimethyl hexane, lauryl peroxide, t-butyl hydroperoxide, α-αbis(t-butylperoxy)diisopropylbenzene, di(2-t-butyl-peroxyisopropyl)benzene, di-t-amyl peroxide, di-t-butyl peroxide. Preferably, the rubber composition includes from about 0.25 to about 5.0 parts by weight peroxide per 100 parts by weight rubber (phr), more preferably 0.5 phr to 3 phr, most preferably 0.5 phr to 1.5 phr. In a most preferred embodiment, the peroxide is present in an amount of about 0.8 phr. These ranges of peroxide are given assuming the peroxide is 100% active, without accounting for any carrier that might be present. Because many commercially available peroxides are sold along with a carrier compound, the actual amount of active peroxide present must be calculated. Commercially-available peroxide initiating agents include DICUP™ family of dicumyl peroxides (including DICUP™ R, DICUP™ 40C and DICUP™ 40KE) available from Crompton (Geo Specialty Chemicals). Similar initiating agents are available from AkroChem, Lanxess, Flexsys/Harwick and R.T. Vanderbilt. Another commercially-available and preferred initiating agent is TRIGONOX™ 265-50B from Akzo Nobel, which is a mixture of 1,1-di(t-butylperoxy)-3,3,5-trimethylcyclohexane and di(2-t-butylperoxyisopropyl)benzene. TRIGONOX™ peroxides are generally sold on a carrier compound.

Suitable reactive co-agents include, but are not limited to, metal salts of diacrylates, dimethacrylates, and monomethacrylates suitable for use in this invention include those wherein the metal is zinc, magnesium, calcium, barium, tin, aluminum, lithium, sodium, potassium, iron, zirconium, and bismuth. Zinc diacrylate (ZDA) is preferred, but the present invention is not limited thereto. ZDA provides golf balls with a high initial velocity. The ZDA can be of various grades of purity. For the purposes of this invention, the lower the quantity of zinc stearate present in the ZDA the higher the ZDA purity. ZDA containing less than about 10% zinc stearate is preferable. More preferable is ZDA containing about 4-8% zinc stearate. Suitable, commercially available zinc diacrylates include those from Sartomer Co. The preferred concentrations of ZDA that can be used are about 10 phr to about 40 phr, more preferably 20 phr to about 35 phr, most preferably 25 phr to about 35 phr. In a particularly preferred embodiment, the reactive co-agent is present in an amount of about 29 phr to about 31 phr.

Additional preferred co-agents that may be used alone or in combination with those mentioned above include, but are not limited to, trimethylolpropane trimethacrylate, trimethylolpropane triacrylate, and the like. It is understood by those skilled in the art, that in the case where these co-agents may be liquids at room temperature, it may be advantageous to disperse these compounds on a suitable carrier to promote ease of incorporation in the rubber mixture.

Antioxidants are compounds that inhibit or prevent the oxidative breakdown of elastomers, and/or inhibit or prevent reactions that are promoted by oxygen radicals. Some exemplary antioxidants that may be used in the present invention include, but are not limited to, quinoline type antioxidants, amine type antioxidants, and phenolic type antioxidants. A preferred antioxidant is 2,2'-methylene-bis-(4-methyl-6-t-butylphenol) available as VANOX®MBPC from R.T. Vanderbilt. Other polyphenolic antioxidants include VANOX® T, VANOX® L, VANOX® SKT, VANOX® SWP, VANOX® 13 and VANOX® 1290.

Suitable antioxidants include, but are not limited to, alkylene-bis-alkyl substituted cresols; substituted phenols; alkylene bisphenols; and alkylene trisphenols. The antioxidant is typically present in an amount of about 0.1 phr to 5 phr, preferably from about 0.1 phr to 2 phr, more preferably about 0.1 phr to 1 phr. In an alternative embodiment, the antioxidant should be present in an amount to ensure that the hardness gradient of the core layers is "negative." Preferably, about 0.2 phr to 1 phr antioxidant is added to the core layer formulation, more preferably, about 0.3 to 0.8 phr, and most preferably 0.4 to 0.7 phr. Preferably, about 0.25 phr to 1.5 phr of peroxide as calculated at 100% active can be added to the core formulation, more preferably about 0.5 phr to 1.2 phr, and most preferably about 0.7 phr to 1.0 phr. The ZDA amount can be varied to suit the desired compression, spin and feel of the resulting golf ball. The cure regime can have a temperature range from about 290° F. to 350° F., more preferably about 300° F. to 335° F., and the stock is held at that temperature for about 10 minutes to 30 minutes.

The thermoset rubber compositions may also include an optional 'soft and fast agent'. As used herein, "soft and fast agent" means any compound or a blend thereof that that is capable of making a core 1) be softer (lower compression) at constant COR or 2) have a higher COR at equal compression, or any combination thereof, when compared to a core equivalently prepared without a soft and fast agent. Preferably, the thermoset core layer compositions may contain about 0.05 phr to 10.0 phr soft and fast agent. In one embodiment, the soft and fast agent is present in an amount of about 0.05 phr to 3.0 phr, preferably about 0.05 phr to 2.0 phr, more preferably about 0.05 phr to 1.0 phr. In another embodiment, the soft and fast agent is present in an amount of about 2.0 phr to 5.0 phr, preferably about 2.35 phr to 4.0 phr, and more preferably about 2.35 phr to 3.0 phr. Suitable soft and fast agents include, but are not limited to, organosulfur or metal-containing organosulfur compounds, an organic sulfur compound, including mono, di, and polysulfides, a thiol, or mercapto compound, an inorganic sulfide compound, a Group VIA compound, or mixtures thereof. The soft and fast agent component may also be a blend of an organosulfur compound and an inorganic sulfide compound.

Fillers may be added to the thermoset rubber layer compositions typically include, but are not limited to, processing aids and/or compounds to affect rheological and mixing properties, density-modifying fillers, tear strength, or reinforcement fillers, and the like. Fillers include materials such as tungsten, zinc oxide, barium sulfate, silica, calcium carbonate, zinc carbonate, metals, metal oxides and salts, regrind (recycled core material typically ground to about 30 mesh particle size), high-Mooney-viscosity rubber regrind, trans-rubber regrind (recycled core material containing high trans isomer of polybutadiene), and the like. When trans-regrind is present, the amount of trans isomer is preferably between about 10% and 60%. The fillers are generally inorganic and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents which may be readily selected by one of ordinary skill in the art. Fillers may include polymeric, ceramic, metal, and glass microspheres may be solid or hollow, and filled or unfilled. Fillers may be added to one or more layers of the golf ball to modify the density thereof.

The thermoset rubber shell and/or core layers may optionally include at least one additive and/or filler. These materials are also suitable for inclusion in the thermoplastic layers of the present invention. Suitable additives and fillers include, but are not limited to, chemical blowing and foaming agents, optical brighteners, coloring agents, fluorescent agents, whitening agents, UV absorbers, light stabilizers, defoaming agents, processing aids, antioxidants, stabilizers, softening agents, fragrance components, plasticizers, impact modifiers, $TiO_2$, acid copolymer wax, surfactants, performance additives (e.g., A-C performance additives, particularly A-C low molecular weight ionomers and copolymers, A-C oxidized polyethylenes, and A-C ethylene vinyl acetate waxes, commercially available from Honeywell International Inc.), fatty acid amides (e.g., ethylene bis-stearamide and ethylene bis-oleamide), fatty acids and salts thereof (e.g., stearic acid, oleic acid, zinc stearate, magnesium stearate, zinc oleate, and magnesium oleate), and fillers, such as zinc oxide, tin oxide, barium sulfate, zinc sulfate, calcium oxide, calcium carbonate, zinc carbonate, barium carbonate, tungsten, tungsten carbide, silica, lead silicate, regrind, clay, mica, talc, nano-fillers, carbon black, glass flake, milled glass, flock, fibers, and mixtures thereof. Suitable additives are more fully described in, U.S. Pat. No. 7,041,721 which issued on May 9, 2006, the disclosure of which is hereby incorporated herein by reference. In a particular embodiment, the total amount of additive(s) and filler(s) present in the particle composition is 20 wt % or less, or 15 wt % or less, or 12 wt % or less, or 10 wt % or less, or 9 wt % or less, or 6 wt % or less, or 5 wt % or less, or 4 wt % or less, or 3 wt % or less, or within a range having a lower limit of 0 or 2 or 3 or 5 wt %, based on the total weight of the particle composition, and an upper limit of 9 or 10 or 12 or 15 or 20 wt %, based on the total weight of the particle composition. In a particular aspect of this embodiment, the particle composition includes fillers selected from carbon black, micro- and nano-scale clays and organoclays, including (e.g., CLOISITE and NANOFIL nanoclays, commercially available from Southern Clay Products, Inc.; NANOMAX and NANOMER nanoclays, commercially available from Nanocor, Inc., and PERKALITE nanoclays, commercially available from Akzo Nobel Polymer Chemicals), micro- and nano-scale talcs (e.g., LUZENAC HAR high aspect ratio talcs, commercially available from Luzenac America, Inc.), glass (e.g., glass flake, milled glass, microglass, and glass fibers), micro- and nano-scale mica and mica-based pigments (e.g., IRIODIN pearl luster pigments, commercially available from The Merck Group), and combinations thereof. Particularly suitable combinations of fillers include, but are not limited to, micro-scale fillers combined with nano-scale fillers, and organic fillers with inorganic fillers.

For the thermoset rubber layers of the invention, the fillers and/or additives are present in an amount of about 50 wt % or less, preferably 30 wt % or less, more preferably 20 wt % or less, and most preferably 15 wt % or less, based on the total weight of the composition. Alternatively, for the thermoplastic layers of the invention, the fillers and/or additives are present in an amount of about 10 wt % or less, more preferably 6 wt % or less, and most preferably 3 wt % or less, based on the total weight of the composition.

The particle composition optionally includes one or more melt flow modifiers. Suitable melt flow modifiers include materials which increase the melt flow of the composition, as measured using ASTM D-1238, condition E, at 190° C., using a 2160-g weight. Examples of suitable melt flow modifiers include, but are not limited to, fatty acids and fatty acid salts, including, but not limited to, those disclosed in U.S. Pat. No. 5,306,760, the disclosure of which is hereby incorporated herein by reference; fatty amides and salts thereof; polyhydric alcohols, including, but not limited to, those disclosed in U.S. Pat. Nos. 7,365,128 and 8,163,823, the entire disclosures of which are hereby incorporated herein by reference; polylactic acids, including, but not limited to, those disclosed in U.S. Pat. No. 7,642,319, the disclosure of which is hereby incorporated herein by reference; and the modifiers disclosed in U.S. Pat. No. 8,163,823 and U.S. Patent Application Publication No. 2009/0203469, the disclosures of which are hereby incorporated herein by reference. Flow enhancing additives also include, but are not limited to, montanic acids, esters of montanic acids and salts thereof, bis-stearoylethylenediamine, mono- and polyalcohol esters such as pentaerythritol tetrastearate, zwitterionic compounds, and metallocene-catalyzed polyethylene and polypropylene wax, including maleic anhydride modified versions thereof, amide waxes and alkylene diamides such as bistearamides. Particularly suitable fatty amides include, but are not limited to, saturated fatty acid monoamides (e.g., lauramide, palmitamide, arachidamide behenamide, stearamide, and 12-hydroxy stearamide); unsaturated fatty acid monoamides (e.g., oleamide, erucamide, and ricinoleamide); N-substituted fatty acid amides (e.g., N-stearyl stearamide, N-behenyl behenamide, N-stearyl behenamide, N-behenyl stearamide, N-oleyl oleamide, N-oleyl stearamide, N-stearyl oleamide, N-stearyl erucamide, erucyl erucamide, and erucyl stearamide, N-oleyl palmitamide, methylol amide (more preferably, methylol stearamide, methylol behenamide); saturated fatty acid bis-amides (e.g., methylene bis-stearamide, ethylene bis-stearamide, ethylene bis-isostearamide, ethylene bis-hydroxystearamide, ethylene bis-behenamide, hexamethylene bis-stearamide, hexamethylene bis-behenamide, hexamethylene bis-hydroxystearamide, N,N'-distearyl adipamide, and N,N'-distearyl sebacamide); unsaturated fatty acid bis-amides (e.g., ethylene bis-oleamide, hexamethylene bis-oleamide, N,N'-dioleyl adipamide, N,N'-dioleyl sebacamide); and saturated and unsaturated fatty acid tetra amides, stearyl erucamide, ethylene bis stearamide and ethylene bis oleamide. Suitable examples of commercially available fatty amides include, but are not limited to, KEMAMIDE fatty acids, such as KEMAMIDE B (behenamide/arachidamide), KEMAMIDE W40 (N,N'-ethylenebisstearamide), KEMAMIDE P181 (oleyl palmitamide), KEMAMIDE S (stearamide), KEMAMIDE U (oleamide), KEMAMIDE E (erucamide), KEMAMIDE O (oleamide), KEMAMIDE W45 (N,N'-ethylenebisstearamide), KENAMIDE W20 (N,N'-ethylenebisoleamide), KEMAMIDE E180 (stearyl erucamide), KEMAMIDE E221 (erucyl erucamide), KEMAMIDE S180 (stearyl stearamide), KEMAMIDE S221 (erucyl stearamide), commercially available from Chemtura Corporation; and CRODAMIDE fatty amides, such as CRODAMIDE OR (oleamide), CRODAMIDE ER (erucamide), CRODAMIDE SR (stereamide), CRODAMIDE BR (behenamide), CRODAMIDE 203 (oleyl palmitamide), and CRODAMIDE 212 (stearyl erucamide), commercially available from Croda Universal Ltd.

The shell layer, and intermediate and outer core layers of the hollow golf ball may also be formed from thermoplastic materials such as ionomeric polymers, and highly- and fully-neutralized ionomers (HNP). Acid moieties of the HNP's, typically ethylene-based ionomers, are preferably neutralized greater than about 80%, more preferably greater than about 90%, and most preferably about 100%. The HNP's can be also be blended with a second polymer component, which, if containing an acid group, may be neutralized in a conventional manner, by the organic fatty acids of the present invention, or both. The second polymer component, which may be partially- or fully-neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

Preferably, the HNP's are ionomers and/or their acid precursors that are preferably neutralized, either fully or partially, with organic acid copolymers or the salts thereof. The acid copolymers are preferably α-olefin, such as ethylene, $C_{3-8}$ α,β-ethylenically unsaturated carboxylic acid, such as acrylic and methacrylic acid, copolymers. They may optionally contain a softening monomer, such as alkyl acrylate and alkyl methacrylate, wherein the alkyl groups have from 1 to 8 carbon atoms.

The acid copolymers can be described as E/X/Y copolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer.

Specific acid-containing ethylene copolymers include, but are not limited to, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include, ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate copolymers. The most preferred acid-containing ethylene copolymers are, ethylene/(meth) acrylic acid/n-butyl, acrylate, ethylene/(meth)acrylic acid/ethyl acrylate, and ethylene/(meth) acrylic acid/methyl acrylate copolymers.

Ionomers are typically neutralized with a metal cation, such as Li, Na, Mg, K, Ca, or Zn. It has been found that by adding sufficient organic acid or salt of organic acid, along with a suitable base, to the acid copolymer or ionomer, however, the ionomer can be neutralized, without losing processability, to a level much greater than for a metal cation. Preferably, the acid moieties are neutralized greater than about 80%, preferably from 90-100%, most preferably 100% without losing processability. This accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%).

The organic acids are typically aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

The ionomers of the invention may also be more conventional ionomers, i.e., partially-neutralized with metal cations. The acid moiety in the acid copolymer is neutralized about 1 to about 90%, preferably at least about 20 to about 75%, and more preferably at least about 40 to about 70%, to form an ionomer, by a cation such as lithium, sodium, potassium, magnesium, calcium, barium, lead, tin, zinc, aluminum, or a mixture thereof.

In a particular embodiment, at least one of the shell layer, the outer core layer, or optional intermediate layer disposed between the shell layer and the outer core layer is formed from an HNP composition comprising an HNP, an additional polymer component, and optionally melt flow modifier(s), additive(s), and/or filler(s). The HNP is preferably formed by reacting the acid polymer with a sufficient amount of cation source, optionally in the presence of a high molecular weight organic acid or salt thereof, such that at least 70%, preferably at least 80%, more preferably at least 90%, more preferably at least 95%, and even more preferably 100%, of all acid groups present are neutralized. In a particular embodiment, the cation source is present in an amount sufficient to neutralize, theoretically, greater than 100%, or 105% or greater, or 110% or greater, or 115% or greater, or 120% or greater, or 125% or greater, or 200% or greater, or 250% or greater of all acid groups present in the composition. The acid polymer can be reacted with the optional high molecular weight organic acid or salt thereof and the cation source simultaneously, or the acid polymer can be reacted with the optional high molecular weight organic acid or salt thereof prior to the addition of the cation source. The acid polymer may be at least partially neutralized prior to contacting the acid polymer with the cation source to form the HNP. Methods of preparing ionomers, and the acid polymers on which ionomers are based, are disclosed, for example, in U.S. Pat. Nos. 3,264,272, and 4,351,931, and U.S. Patent Application Publication No. 2002/0013413.

The HNP composition optionally contains one or more melt flow modifiers. The amount of melt flow modifier in the composition is readily determined such that the melt flow index of the composition is at least 0.1 g/10 min, preferably from 0.5 g/10 min to 10.0 g/10 min, and more preferably from 1.0 g/10 min to 6.0 g/10 min, as measured using ASTM D-1238, condition E, at 190° C., using a 2160 gram weight.

Suitable melt flow modifiers include, but are not limited to, the high molecular weight organic acids and salts thereof disclosed above, polyamides, polyesters, polyacrylates, polyurethanes, polyethers, polyureas, polyhydric alcohols, and combinations thereof. Also suitable are the non-fatty acid melt flow modifiers disclosed in U.S. Pat. Nos. 7,365,128 and 7,402,629, the entire disclosures of which are hereby incorporated herein by reference.

The HNP composition optionally includes additive(s) and/or filler(s) in an amount within a range having a lower limit of 0 or 5 or 10 wt %, and an upper limit of 15 or 20 or 25 or 30 or 50 wt %, based on the total weight of the composition. Suitable additives and fillers include, but are not limited to, chemical blowing and foaming agents, optical brighteners, coloring agents, fluorescent agents, whitening agents, UV absorbers, light stabilizers, defoaming agents, processing aids, mica, talc, nano-fillers, antioxidants, stabilizers, softening agents, fragrance components, plasticizers, impact modifiers, $TiO_2$, acid copolymer wax, surfactants, and fillers, such as zinc oxide, tin oxide, barium sulfate, zinc sulfate, calcium oxide, calcium carbonate, zinc carbonate, barium carbonate, clay, tungsten, tungsten carbide, silica, lead silicate, regrind (recycled material), and mixtures thereof. Suitable additives are more fully disclosed, for example, in U.S. Patent Application Publication No. 2003/0225197, the entire disclosure of which is hereby incorporated herein by reference.

In some embodiments, the HNP composition is a "moisture resistant" HNP composition, i.e., having a moisture vapor transmission rate ("MVTR") of 8 g-mil/100 $in^2$/day or less (i.e., 3.2 g-mm/$m^2$·day or less), or 5 g-mil/100 $in^2$/day or less (i.e., 2.0 g-mm/$m^2$·day or less), or 3 g-mil/100 $in^2$/day or less (i.e., 1.2 g-mm/$m^2$·day or less), or 2 g-mil/100 $in^2$/day or less (i.e., 0.8 g-mm/$m^2$·day or less), or 1 g-mil/100 $in^2$/day or less (i.e., 0.4 g-mm/$m^2$·day or less), or less than 1 g-mil/100 $in^2$/day (i.e., less than 0.4 g-mm/$m^2$·day). Suitable moisture resistant HNP compositions are disclosed, for example, in U.S. Patent Application Publication Nos. 2005/0267240, 2006/0106175, and 2006/0293464, the entire disclosures of which are hereby incorporated herein by reference.

The HNP composition is not limited by any particular method or any particular equipment for making the composition. In a preferred embodiment, the composition is prepared by the following process. The acid polymer(s), optional melt flow modifier(s), and optional additive(s)/filler(s) are simultaneously or individually fed into a melt extruder, such as a single or twin screw extruder. A suitable amount of cation source is then added such that at least 70%, or at least 80%, or at least 90%, or at least 95%, or at least 100%, of all acid groups present are neutralized. Optionally, the cation source is added in an amount sufficient to neutralize, theoretically, 105% or greater, or 110% or greater, or 115% or greater, or 120% or greater, or 125% or greater, or 200% or greater, or 250% or greater of all acid groups present in the composition. The acid polymer may be at least partially neutralized prior to the above process. The components are intensively mixed prior to being extruded as a strand from the die-head.

The HNP composition comprises at least one additional polymer component selected from partially neutralized ionomers as disclosed, for example, in U.S. Patent Application Publication No. 2006/0128904, the entire disclosure of which is hereby incorporated herein by reference; bimodal ionomers, such as those disclosed in U.S. Patent Application Publication No. 2004/0220343 and U.S. Pat. Nos. 6,562,906, 6,762,246, 7,273,903, 8,193,283, 8,410,219, and 8,410,220, the entire disclosures of which are hereby incorporated herein by reference, and particularly Surlyn® AD 1043, 1092, and 1022 ionomer resins, commercially available from E. I. du Pont de Nemours and Company; ionomers modified with rosins, such as those disclosed in U.S. Patent Application Publication No. 2005/0020741, the entire disclosure of which is hereby incorporated by reference; soft and resilient ethylene copolymers, such as those disclosed U.S. Patent Application Publication No. 2003/0114565, the entire disclosure of which is hereby incorporated herein by reference; polyolefins, such as linear, branched, or cyclic, $C_2$-$C_{40}$ olefins, particularly polymers comprising ethylene or propylene copolymerized with one or more $C_2$-$C_{40}$ olefins, $C_3$-$C_{20}$ α-olefins, or $C_3$-$C_{10}$ α-olefins; polyamides; polyesters; polyethers; polycarbonates; polysulfones; polyacetals; polylactones; acrylonitrile-butadiene-styrene resins; polyphenylene oxide; polyphenylene sulfide; styrene-acrylonitrile resins; styrene maleic anhydride; polyimides; aromatic polyketones; ionomers and ionomeric precursors, acid copolymers, and conventional HNPs, such as those disclosed in U.S. Pat. Nos. 6,756,436, 6,894,098, and 6,953,820, the entire disclosures of which are hereby incorporated herein by reference; polyurethanes; grafted and non-grafted metallocene-catalyzed polymers, such as single-site catalyst polymerized polymers, high crystalline acid polymers, cationic ionomers, and combinations thereof; natural and synthetic rubbers, including, but not limited to, ethylene propylene rubber ("EPR"), ethylene propylene diene rubber ("EPDM"), styrenic block copolymer rubbers (such as SI, SIS, SB, SBS, SIBS, and the like, where "S" is styrene, "I" is isobutylene, and "B" is butadiene), butyl rubber, halobutyl rubber, copolymers of isobutylene and para-alkylstyrene, halogenated copolymers of isobutylene and para-alkylstyrene, natural rubber, polyisoprene, copolymers of butadiene with acrylonitrile, polychloroprene, alkyl acrylate rubber (such as ethylene-alkyl acrylates and ethylene-alkyl methacrylates, and, more specifically, ethylene-ethyl acrylate, ethylene-methyl acrylate, and ethylene-butyl acrylate), chlorinated isoprene rubber, acrylonitrile chlorinated isoprene rubber, and polybutadiene rubber (cis and trans). Additional suitable blend polymers include those described in U.S. Pat. No. 5,981,658, for example at column 14, lines 30 to 56, the entire disclosure of which is hereby incorporated herein by reference. The blend may be produced by post-reactor blending, by connecting reactors in series to make reactor blends, or by using more than one catalyst in the same reactor to produce multiple species of polymer. The polymers may be mixed prior to being put into an extruder, or they may be mixed in an extruder. In a particular embodiment, the HNP composition comprises an acid copolymer and an additional polymer component, wherein the additional polymer component is a non-acid polymer present in an amount of greater than 50 wt %, or an amount within a range having a lower limit of 50 or 55 or 60 or 65 or 70 and an upper limit of 80 or 85 or 90, based on the combined weight of the acid copolymer and the non-acid polymer. In another particular embodiment, the HNP composition comprises an acid copolymer and an additional polymer component, wherein the additional polymer component is a non-acid polymer present in an amount of less than 50 wt %, or an amount within a range having a lower limit of 10 or 15 or 20 or 25 or 30 and an upper limit of 40 or 45 or 50, based on the combined weight of the acid copolymer and the non-acid polymer.

HNP compositions of the present invention, in the neat (i.e., unfilled) form, preferably have a specific gravity of from 0.95 g/cc to 0.99 g/cc. Any suitable filler, flake, fiber, particle, or the like, of an organic or inorganic material may be added to the HNP composition to increase or decrease the specific gravity, particularly to adjust the weight distribution within the golf ball, as further disclosed in U.S. Pat. Nos. 6,494,795, 6,547,677, 6,743,123, 7,074,137, and 6,688,991, the entire disclosures of which are hereby incorporated herein by reference.

In a particular embodiment, the HNP composition is selected from the relatively soft HNP compositions disclosed in U.S. Pat. No. 7,468,006, the entire disclosure of which is hereby incorporated herein by reference, and the low modulus HNP compositions disclosed in U.S. Pat. No. 7,207,903, the entire disclosure of which is hereby incorporated herein by reference. In a particular aspect of this embodiment, a sphere formed from the HNP composition has a compression of 80 or less, or 70 or less, or 65 or less, or 60 or less, or 50 or less, or 40 or less, or 30 or less, or 20 or less. In another particular aspect of this embodiment, the HNP composition has a material hardness within a range having a lower limit of 40 or 50 or 55 Shore C and an upper limit of 70 or 80 or 87 Shore C, or a material hardness of 55 Shore D or less, or a material hardness within a range having a lower limit of 10 or 20 or 30 or 37 or 39 or 40 or 45 Shore D and an upper limit of 48 or 50 or 52 or 55 or 60 or 80 Shore D. In yet another particular aspect of this embodiment, the HNP composition comprises an HNP having a modulus within a range having a lower limit of 1,000 or 5,000 or 10,000 psi and an upper limit of 17,000 or 25,000 or 28,000 or 30,000 or 35,000 or 45,000 or 50,000 or 55,000 psi, as measured using a standard flex bar according to ASTM D790-B.

In another particular embodiment, the HNP composition is selected from the relatively hard HNP compositions disclosed in U.S. Pat. No. 7,468,006, the entire disclosure of which is hereby incorporated herein by reference, and the high modulus HNP compositions disclosed in U.S. Pat. No. 7,207,903, the entire disclosure of which is hereby incorporated herein by reference. In a particular aspect of this embodiment, a sphere formed from the HNP composition has a compression of 70 or greater, or 80 or greater, or a compression within a range having a lower limit of 70 or 80 or 90 or 100 and an upper limit of 110 or 130 or 140. In another particular aspect of this embodiment, the HNP composition has a material hardness of 35 Shore D or greater, or 45 Shore D or greater, or a material hardness within a range having a lower limit of 45 or 50 or 55 or 57 or 58 or 60 or 65 or 70 or 75 Shore D and an upper limit of 75 or 80 or 85 or 90 or 95 Shore D. In yet another particular aspect of this embodiment, the HNP composition comprises an HNP having a modulus within a range having a lower limit of 25,000 or 27,000 or 30,000 or 40,000 or 45,000 or 50,000 or 55,000 or 60,000 psi and an upper limit of 72,000 or 75,000 or 100,000 or 150,000 psi, as measured using a standard flex bar according to ASTM D790-B.

Suitable HNP compositions are further disclosed, for example, in U.S. Pat. Nos. 6,653,382, 6,756,436, 6,777,472, 6,815,480, 6,894,098, 6,919,393, 6,953,820, 6,994,638, 7,375,151, the entire disclosures of which are hereby incorporated herein by reference.

In a particular embodiment, the HNP composition is formed by blending an acid polymer, a non-acid polymer, a cation source, and a fatty acid or metal salt thereof. For purposes of the present invention, maleic anhydride modified polymers are defined herein as a non-acid polymer despite having anhydride groups that can ring-open to the acid form during processing of the polymer to form the HNP compositions herein. The maleic anhydride groups are grafted onto a polymer, are present at relatively very low levels, and are not part of the polymer backbone, as is the case with the acid polymers, which are exclusively E/X and E/X/Y copolymers of ethylene and an acid, particularly methacrylic acid and acrylic acid.

In a particular aspect of this embodiment, the acid polymer is selected from ethylene-acrylic acid and ethylene-methacrylic acid copolymers, optionally containing a softening monomer selected from n-butyl acrylate and iso-butyl acrylate. The acid polymer preferably has an acid content with a range having a lower limit of 2 or 10 or 15 or 16 mol % and an upper limit of 20 or 25 or 26 or 30 mol %. Examples of particularly suitable commercially available acid polymers include, but are not limited to, those given in Table 1 below.

TABLE 1

| Acid Polymer | Acid (wt %) | Softening Monomer (wt %) | Melt Index (2.16 kg, 190° C., g/10 min) |
|---|---|---|---|
| Nucrel ® 9-1 | methacrylic acid (9.0) | n-butyl acrylate (23.5) | 25 |
| Nucrel ® 599 | methacrylic acid (10.0) | none | 450 |
| Nucrel ® 960 | methyacrylic acid (15.0) | none | 60 |
| Nucrel ® 0407 | methacrylic acid (4.0) | none | 7.5 |
| Nucrel ® 0609 | methacrylic acid (6.0) | none | 9 |
| Nucrel ® 1214 | methacrylic acid (12.0) | none | 13.5 |
| Nucrel ® 2906 | methacrylic acid (19.0) | none | 60 |

TABLE 1-continued

| Acid Polymer | Acid (wt %) | Softening Monomer (wt %) | Melt Index (2.16 kg, 190° C., g/10 min) |
|---|---|---|---|
| Nucrel ® 2940 | methacrylic acid (19.0) | none | 395 |
| Nucrel ® 30707 | acrylic acid (7.0) | none | 7 |
| Nucrel ® 31001 | acrylic acid (9.5) | none | 1.3 |
| Nucrel ® AE | methacrylic acid (2.0) | isobutyl acrylate (6.0) | 11 |
| Nucrel ® 2806 | acrylic acid (18.0) | none | 60 |
| Nucrel ® 0403 | methacrylic acid (4.0) | none | 3 |
| Nucrel ® 925 | methacrylic acid (15.0) | none | 25 |
| Escor ® AT-310 | acrylic acid (6.5) | methyl acrylate (6.5) | 6 |
| Escor ® AT-325 | acrylic acid (6.0) | methyl acrylate (20.0) | 20 |
| Escor ® AT-320 | acrylic acid (6.0) | methyl acrylate (18.0) | 5 |
| Escor ® 5070 | acrylic acid (9.0) | none | 30 |
| Escor ® 5100 | acrylic acid (11.0) | none | 8.5 |
| Escor ® 5200 | acrylic acid (15.0) | none | 38 |
| A-C ® 5120 | acrylic acid (15) | none | not reported |
| A-C ® 540 | acrylic acid (5) | none | not reported |
| A-C ® 580 | acrylic acid (10) | none | not reported |
| Primacor ® 3150 | acrylic acid (6.5) | none | 5.8 |
| Primacor ® 3330 | acrylic acid (3.0) | none | 11 |
| Primacor ® 5985 | acrylic acid (20.5) | none | 240 |
| Primacor ® 5986 | acrylic acid (20.5) | none | 300 |
| Primacor ® 5980I | acrylic acid (20.5) | none | 300 |
| Primacor ® 5990I | acrylic acid (20.0) | none | 1300 |
| XUS 60751.17 | acrylic acid (19.8) | none | 600 |
| XUS 60753.02L | acrylic acid (17.0) | none | 60 |

Nucrel ® acid polymers are commercially available from E. I. du Pont de Nemours and Company.
Escor ® acid polymers are commercially available from ExxonMobil Chemical Company.
A-C ® acid polymers are commercially available from Honeywell International Inc.
Primacor ® acid polymers and XUS acid polymers are commercially available from The Dow Chemical Company.

In another particular aspect of this embodiment, the non-acid polymer is an elastomeric polymer. Suitable elastomeric polymers include, but are not limited to:

(a) ethylene-alkyl acrylate polymers, particularly polyethylene-butyl acrylate, polyethylene-methyl acrylate, and polyethylene-ethyl acrylate;
(b) metallocene-catalyzed polymers;
(c) ethylene-butyl acrylate-carbon monoxide polymers and ethylene-vinyl acetate-carbon monoxide polymers;
(d) polyethylene-vinyl acetates;
(e) ethylene-alkyl acrylate polymers containing a cure site monomer;
(f) ethylene-propylene rubbers and ethylene-propylene-diene monomer rubbers;
(g) olefinic ethylene elastomers, particularly ethylene-octene polymers, ethylene-butene polymers, ethylene-propylene polymers, and ethylene-hexene polymers;

(h) styrenic block copolymers;
(i) polyester elastomers;
(j) polyamide elastomers;
(k) polyolefin rubbers, particularly polybutadiene, polyisoprene, and styrene-butadiene rubber; and
(l) thermoplastic polyurethanes.

Examples of particularly suitable commercially available non-acid polymers include, but are not limited to, Lotader® ethylene-alkyl acrylate polymers and Lotryl® ethylene-alkyl acrylate polymers, and particularly Lotader® 4210, 4603, 4700, 4720, 6200, 8200, and AX8900 commercially available from Arkema Corporation; Elvaloy® AC ethylene-alkyl acrylate polymers, and particularly AC 1224, AC 1335, AC 2116, AC3117, AC3427, and AC34035, commercially available from E. I. du Pont de Nemours and Company; Fusabond® elastomeric polymers, such as ethylene vinyl acetates, polyethylenes, metallocene-catalyzed polyethylenes, ethylene propylene rubbers, and polypropylenes, and particularly Fusabond® N525, C190, C250, A560, N416, N493, N614, P614, M603, E100, E158, E226, E265, E528, and E589, commercially available from E. I. du Pont de Nemours and Company; Honeywell A-C polyethylenes and ethylene maleic anhydride copolymers, and particularly A-C 5180, A-C 575, A-C 573, A-C 655, and A-C 395, commercially available from Honeywell; Nordel® IP rubber, Elite® polyethylenes, Engage® elastomers, and Amplify® functional polymers, and particularly Amplify® GR 207, GR 208, GR 209, GR 213, GR 216, GR 320, GR 380, and EA 100, commercially available from The Dow Chemical Company; Enable® metallocene polyethylenes, Exact® plastomers, Vistamaxx® propylene-based elastomers, and Vistalon® EPDM rubber, commercially available from ExxonMobil Chemical Company; Starflex® metallocene linear low density polyethylene, commercially available from LyondellBasell; Elvaloy® HP4051, HP441, HP661 and HP662 ethylene-butyl acrylate-carbon monoxide polymers and Elvaloy® 741, 742 and 4924 ethylene-vinyl acetate-carbon monoxide polymers, commercially available from E. I. du Pont de Nemours and Company; Evatane® ethylene-vinyl acetate polymers having a vinyl acetate content of from 18 to 42%, commercially available from Arkema Corporation; Elvax® ethylene-vinyl acetate polymers having a vinyl acetate content of from 7.5 to 40%, commercially available from E. I. du Pont de Nemours and Company; Vamac® G terpolymer of ethylene, methylacrylate and a cure site monomer, commercially available from E. I. du Pont de Nemours and Company; Vistalon® EPDM rubbers, commercially available from ExxonMobil Chemical Company; Kraton® styrenic block copolymers, and particularly Kraton® FG1901GT, FG1924GT, and RP6670GT, commercially available from Kraton Performance Polymers Inc.; Septon® styrenic block copolymers, commercially available from Kuraray Co., Ltd.; Hytrel® polyester elastomers, and particularly Hytrel® 3078, 4069, and 556, commercially available from E. I. du Pont de Nemours and Company; Riteflex® polyester elastomers, commercially available from Celanese Corporation; Pebax® thermoplastic polyether block amides, and particularly Pebax® 2533, 3533, 4033, and 5533, commercially available from Arkema Inc.; Affinity® and Affinity® GA elastomers, Versify® ethylene-propylene copolymer elastomers, and Infuse® olefin block copolymers, commercially available from The Dow Chemical Company; Exxelor® polymer resins, and particularly Exxelor® PE 1040, PO 1015, PO 1020, VA 1202, VA 1801, VA 1803, and VA 1840, commercially available from ExxonMobil Chemical Company; and Royaltuf® EPDM, and particularly Royaltuf® 498 maleic anhydride modified polyolefin based on an amorphous EPDM and Royaltuf® 485 maleic anhydride modified polyolefin based on an semi-crystalline EPDM, commercially available from Chemtura Corporation.

Additional examples of particularly suitable commercially available elastomeric polymers include, but are not limited to, those given in Table 2 below.

TABLE 2

| | % Ester | % Maleic Anhydride | Melt Index (2.16 kg, 190° C., g/10 min) |
|---|---|---|---|
| Polyethylene Butyl Acrylates | | | |
| Lotader ® 3210 | 6 | 3.1 | 5 |
| Lotader ® 4210 | 6.5 | 3.6 | 9 |
| Lotader ® 3410 | 17 | 3.1 | 5 |
| Lotryl ® 17BA04 | 16-19 | 0 | 3.5-4.5 |
| Lotryl ® 35BA320 | 33-37 | 0 | 260-350 |
| Elvaloy ® AC 3117 | 17 | 0 | 1.5 |
| Elvaloy ® AC 3427 | 27 | 0 | 4 |
| Elvaloy ® AC 34035 | 35 | 0 | 40 |
| Polyethylene Methyl Acrylates | | | |
| Lotader ® 4503 | 19 | 0.3 | 8 |
| Lotader ® 4603 | 26 | 0.3 | 8 |
| Lotader ® AX 8900 | 26 | 8% GMA | 6 |
| Lotryl ® 24MA02 | 23-26 | 0 | 1-3 |
| Elvaloy ® AC 12024S | 24 | 0 | 20 |
| Elvaloy ® AC 1330 | 30 | 0 | 3 |
| Elvaloy ® AC 1335 | 35 | 0 | 3 |
| Elvaloy ® AC 1224 | 24 | 0 | 2 |
| Polyethylene Ethyl Acrylates | | | |
| Lotader ® 6200 | 6.5 | 2.8 | 40 |
| Lotader ® 8200 | 6.5 | 2.8 | 200 |
| Lotader ® LX 4110 | 5 | 3.0 | 5 |
| Lotader ® HX 8290 | 17 | 2.8 | 70 |
| Lotader ® 5500 | 20 | 2.8 | 20 |
| Lotader ® 4700 | 29 | 1.3 | 7 |
| Lotader ® 4720 | 29 | 0.3 | 7 |
| Elvaloy ® AC 2116 | 16 | 0 | 1 |

The acid polymer and non-acid polymer are combined and reacted with a cation source, such that at least 80% of all acid groups present are neutralized. The present invention is not meant to be limited by a particular order for combining and reacting the acid polymer, non-acid polymer and cation source. In a particular embodiment, the fatty acid or metal salt thereof is used in an amount such that the fatty acid or metal salt thereof is present in the HNP composition in an amount of from 10 wt % to 60 wt %, or within a range having a lower limit of 10 or 20 or 30 or 40 wt % and an upper limit of 40 or 50 or 60 wt %, based on the total weight of the HNP composition. Suitable cation sources and fatty acids and metal salts thereof are further disclosed above.

In another particular aspect of this embodiment, the acid polymer is an ethylene-acrylic acid polymer having an acid content of 19 wt % or greater, the non-acid polymer is a metallocene-catalyzed ethylene-butene copolymer, optionally modified with maleic anhydride, the cation source is magnesium, and the fatty acid or metal salt thereof is magnesium oleate present in the composition in an amount of 20 to 50 wt %, based on the total weight of the composition.

Preferred thermoplastic materials are disclosed in U.S. Pat. No. 7,591,742, the disclosure of which is incorporated herein in its entirety by reference thereto.

Thermoplastic elastomers (TPE) many also be used for the thermoplastic shell or core layers and/or to modify the properties of the shell and/or core layers, or the uncured rubber core layer stock by blending with the base thermoset rubber. These TPEs include natural or synthetic balata, or high trans-polyisoprene, high trans-polybutadiene, or any styrenic block copolymer, such as styrene ethylene butadiene styrene, styrene-isoprene-styrene, etc., a metallocene or other single-site catalyzed polyolefin such as ethylene-octene, or ethylene-butene, or thermoplastic polyurethanes (TPU), including copolymers, e.g. with silicone. Other suitable TPEs for blending with the thermoset rubbers of the present invention include PEBAX®, which is believed to comprise polyether amide copolymers, HYTREL®, which is believed to comprise polyether ester copolymers, thermoplastic urethane, and KRATON®, which is believed to comprise styrenic block copolymers elastomers. Any of the TPEs or TPUs above may also contain functionality suitable for grafting, including maleic acid or maleic anhydride.

Additional polymers may also optionally be incorporated into the base rubber for the shell and core layers. Examples include, but are not limited to, thermoset elastomers such as core regrind, thermoplastic vulcanizate, copolymeric ionomer, terpolymeric ionomer, polycarbonate, polyamide, copolymeric polyamide, polyesters, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, styrene-acrylonitrile polymer (SAN) (including olefin-modified SAN and acrylonitrile-styrene-acrylonitrile polymer), styrene-maleic anhydride copolymer, styrenic copolymer, functionalized styrenic copolymer, functionalized styrenic terpolymer, styrenic terpolymer, cellulose polymer, liquid crystal polymer, ethylene-vinyl acetate copolymers, polyurea, and polysiloxane or any metallocene-catalyzed polymers of these species.

Suitable polyamides for use as an additional polymeric material in compositions within the scope of the present invention also include resins obtained by: (1) polycondensation of (a) a dicarboxylic acid, such as oxalic acid, adipic acid, sebacic acid, terephthalic acid, isophthalic acid, or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexanediamine, or m-xylylenediamine; (2) a ring-opening polymerization of cyclic lactam, such as Є-caprolactam or Ω-laurolactam; (3) polycondensation of an aminocarboxylic acid, such as 6-aminocaproic acid, 9-aminononanoic acid, 11-aminoundecanoic acid, or 12-aminododecanoic acid; or (4) copolymerization of a cyclic lactam with a dicarboxylic acid and a diamine. Specific examples of suitable polyamides include NYLON 6, NYLON 66, NYLON 610, NYLON 11, NYLON 12, copolymerized NYLON, NYLON MXD6, and NYLON 46.

The hollow interior of the shell layer has a diameter of about 0.1 inches to about 1.1 inches, preferably about 0.2 inches to about 0.9 inches, more preferably about 0.25 inches to about 0.75 inches, and most preferably about 0.3 inches to about 0.5 inches. In one preferred embodiment, the hollow interior of the shell layer has a diameter of greater than 0.5 inches. The shell layer has a thickness that ranges from 0.01 inches to about 0.4 inches. When the shell layer is desired to be relatively thick, the shell layer thickness is about 0.125 inches to about 0.375 inches, preferably about 0.2 inches to about 0.3125 inches, more preferably about 0.25 inches to about 0.3 inches, and most preferably about 0.26 inches to about 0.275 inches. When the shell layer is desired to be relatively thin, the shell layer thickness is about 0.01 inches to about 0.1 inches, preferably about 0.02 inches to about 0.075 inches, more preferably about 0.025 inches to about 0.04 inches, and most preferably about 0.03 inches to about 0.035 inches. When the shell layer is relatively thin and formed from a thermoplastic material, the TP material is preferably selected to be somewhat heat resistant (or blended with a heat resistant TP material) to avoid melting of the layer by subsequent molding of additional core and/or cover layers.

With the dimensions of the hollow interior in mind, the hollow cores (shell layer, shell layer and outer core layer(s)) of the invention preferably have an outer diameter of about 0.75 inches to about 1.58 inches, preferably about 1.0 inches to about 1.57 inches, more preferably about 1.3 inches to about 1.56 inches, and most preferably about 1.4 inches to about 1.55 inches. In preferred embodiments, the shell layer has an outer diameter of about 0.75 inches, 1.0 inches, 1.20 inches, or 1.30 inches, with a most preferred outer diameter being 0.75 inches or 1.0 inches. In an alternative embodiment, the outer core layer should have an outer diameter (the entire hollow core, shell layer plus outer core layer) of about 1.30 inches to about 1.62 inches, preferably 1.4 inches to about 1.6 inches, and more preferably about 1.5 inches to about 1.59 inches. In preferred embodiments, the outer core layer has an outer diameter of about 1.51 inches, 1.53 inches, or most preferably 1.550 inches.

The inner and outer cover layers preferably have a thickness of about 0.010 to 0.080 inches, more preferably about 0.015 to 0.060 inches, and most preferably about 0.020 to 0.040 inches. Alternatively, the inner and outer cover layers have a thickness of about 0.015 inches to about 0.055 inches, more preferably about 0.02 inches to about 0.04 inches, and most preferably about 0.025 inches to about 0.035 inches. The inner cover layer, if present, preferably has a hardness of about 60 Shore D or greater, more preferably about 65 Shore D or greater, and most preferably about 70 Shore D or greater. The inner cover layer is preferably harder than the outer cover layer although in one embodiment the outer cover layer is harder than the inner cover layer. The outer cover layer preferably has a hardness of about 60 Shore D or less, more preferably about 55 Shore D or less, and most preferably about 50 Shore D or less.

Formation of the shell and outer core layers of the invention may be accomplished in a variety of ways, such as those disclosed in U.S. Pat. Nos. 5,480,155; 6,315,683, and 8,262,508, the disclosures of which are incorporated herein, in their entirety, by reference thereto.

Golf balls of the present invention include a hollow core which is formed from a shell layer that contains a spherical hollow portion in its interior. The spherical inner core shell layer is formed from a thermoset rubber composition or a thermoplastic composition. In a particular embodiment, the spherical inner core shell layer is formed from an ionomer composition, a fully-neutralized ionomer composition, or a highly neutralized polymer composition. The shell layer has an outer surface, an inner surface, and an inner diameter that define the dimensions of the hollow center. The outer core layer is formed from a thermoset rubber composition or a thermoplastic composition, which may be the same as or a different composition than the shell layer. In one embodiment, a thermoplastic outer core layer is formed over a thermoset shell layer, resulting in a TS/TP hollow core. In another embodiment, a thermoset outer core layer is formed over a thermoset shell layer, resulting in a TS/TS hollow core. In another embodiment, a thermoset outer core layer is formed over a thermoplastic shell layer, resulting in a TP/TS hollow core. In another embodiment, a thermoplastic outer core layer is formed over a thermoplastic shell layer, resulting in a TP/TP hollow core. In a particular aspect of this embodiment, the outer core layer is formed from an ionomeric composition.

A cover of one or more layers is formed around the outer core layer. In a particular embodiment, the cover includes an inner cover layer formed from an ionomeric material and an outer cover layer formed from a polyurethane or polyurea material. In a particular aspect of this embodiment, the hardness of the outer cover layer is less than that of the inner cover layer. In another particular aspect of this embodiment, the inner cover layer has a hardness of greater than about 60 Shore D and the outer cover layer has a hardness of less than about 60 Shore D. In another particular aspect of this embodiment, the hardness of the outer cover layer is greater than that of the inner cover layer.

The hollow center has a diameter of about 0.15 to 1.1 inches, preferably about 0.25 to 1.0 inches, more preferably about 0.25 to 0.75 inches, and most preferably about 0.3 to 0.5 inches.

In a particular embodiment, the shell layer has an outer surface hardness of greater than about 55 Shore C.

In a particular embodiment, the shell layer is thermoset and the outer surface hardness of the shell layer is greater than the inner surface hardness of the shell layer by about 3 to 25 Shore C to define a first hardness gradient.

In another particular embodiment, the shell layer is thermoplastic and the outer surface hardness of the shell layer is the same as the inner surface hardness of the shell layer, or the outer surface hardness of the shell layer is greater than the inner surface hardness of the shell layer by about 1 to 5 Shore C, to define a first hardness gradient.

The outer core layer has a second hardness gradient. In a particular embodiment, the shell layer is thermoplastic, the outer core layer is thermoset, and the hardness gradient of the outer core layer is greater than the hardness gradient of the shell layer. In another particular embodiment, the shell layer is thermoplastic, the outer core layer is thermoplastic, and the hardness gradient of the outer core layer is the same as or greater than the hardness gradient of the shell layer. In another particular embodiment, the shell layer is thermoset, the outer core layer is thermoset, and the outer core layer has a hardness gradient that is different from the hardness gradient of the shell layer.

In another particular embodiment, the outer core layer is thermoplastic and has a 'zero hardness gradient'. The zero hardness gradient is typically about 0 Shore C (defined herein as ±2 Shore C). The hardness gradient of the thermoplastic outer core layer may also have a 'negative hardness gradient', preferably about 1 to 10 Shore C, more preferably about 2 to 8 Shore C, and most preferably about 3 to 5 Shore C In another particular embodiment, the outer core layer is thermoplastic and has a 'positive hardness gradient', preferably about 1 to 10 Shore C, more preferably about 2 to 8 Shore C, and most preferably about 3 to 5 Shore C.

In another particular embodiment, the outer core layer is thermoset and has a 'zero hardness gradient'. The zero hardness gradient is typically about 0 Shore C (defined herein as ±2 Shore C). The hardness gradient of the thermoset outer core layer may also have a 'negative hardness gradient', preferably about 3 to 25 Shore C, more preferably about 5 to 20 Shore C, and most preferably about 8 to 15 Shore C.

In another particular embodiment, the outer core layer is thermoset and has a 'positive hardness gradient', preferably about 3 to 25 Shore C, more preferably about 5 to 20 Shore C, and most preferably about 8 to 15 Shore C.

The spherical inner core shell layer has a coefficient of restitution (COR) less than about 0.750 when measured at an incoming velocity of 125 ft/s. Preferably, the COR is less than about 0.700, more preferably about 0.500 to 0.700, and most preferably about 0.600 to 0.700. The overall core (the combination of the hollow core and any outer core layers) has a COR, measured at an incoming velocity of 125 ft/s, higher than the COR of the inner core shell layer by greater than about 5%, more preferably about 10 to 50%, and most preferably about 15 to 30%.

The golf ball has a first volume and the hollow center has a second volume. In a particular embodiment, the volume of the hollow center is about 2% to 30% of the golf ball volume, more preferably about 5% to 25% of the golf ball volume, and most preferably about 10% to 20% of the golf ball volume.

In one embodiment, the inner core shell layer is thermoplastic and has a COR less than about 0.750 when measured at an incoming velocity of 125 ft/s. Preferably, the COR is less than about 0.700, more preferably about 0.500 to 0.700, and most preferably about 0.600 to 0.700. In a particular aspect of this embodiment, the inner core shell layer is thermoplastic, the outer core layer is thermoplastic and the overall hollow core (the combination of the thermoplastic shell layer and the thermoplastic outer core layer) has a COR, measured at an incoming velocity of 125 ft/s, higher than the COR of the inner core shell layer by greater than about 5%, more preferably about 10 to 50%, and most preferably about 15 to 30%.

Figure 1A:
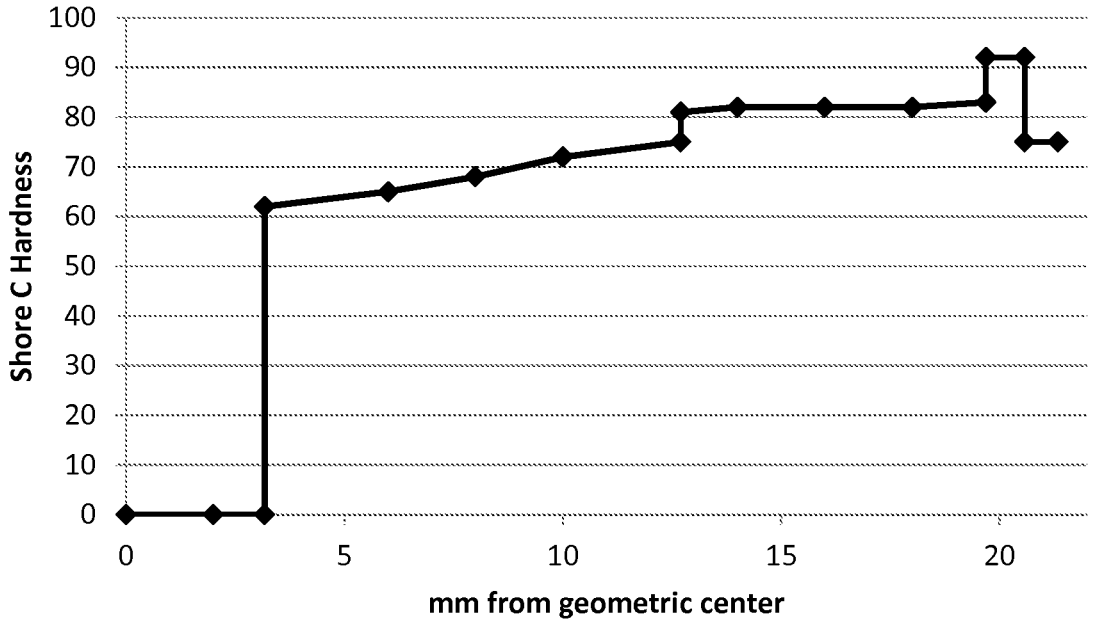
FIG. 1*a* is a plot of Shore C hardness versus distance from the center for an embodiment of a thermoset (TS)/thermoplastic (TP) hollow core golf ball.
Figure 1B:
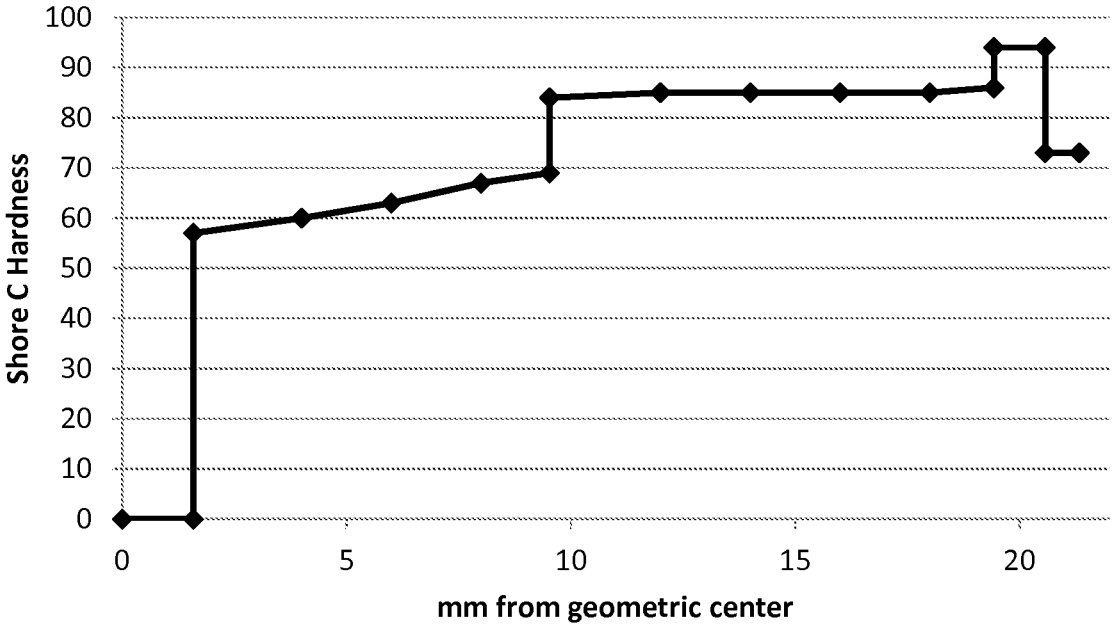
FIG. 1*b* is a plot of Shore C hardness versus distance from the center for an embodiment of a thermoset (TS)/thermoplastic (TP) hollow core golf ball.

Referring to FIGS. 1*a* and 1*b*, two different embodiments of the TS/TP hollow core golf ball are disclosed. FIG. 1*a* depicts a hardness profile for a golf ball having a hollow core, an ionomer inner cover layer, and a polyurethane outer cover layer. The thermoset shell layer has a thickness of about 0.375 inches and an outer diameter of about 1.0 inches, and the spherical hollow interior has a diameter of about 0.25 inches. The thermoset shell layer has a 'positive hardness gradient' of about 12 across its thickness. The thermoplastic HNP outer core layer has a thickness of about 0.275 inches and an outer diameter of about 1.55 inches. The thermoplastic HNP outer core layer has a 'zero hardness gradient' across its thickness. The inner cover layer has a thickness of about 0.035 inches and the outer cover layer has a thickness of about 0.03 inches. FIG. 1*b* depicts a hardness profile for another golf ball having a hollow core, an ionomer inner cover layer, and a polyurethane outer cover layer. The thermoset shell layer has a thickness of about 0.3125 inches and an outer diameter of about 0.75 inches, and the spherical hollow interior has a diameter of about 0.125 inches. The thermoset shell layer has a 'positive hardness gradient' of about 12 across its thickness. The thermoplastic HNP outer core layer has a thickness of about 0.39 inches and an outer diameter of about 1.53 inches. The thermoplastic HNP outer core layer has a 'zero hardness gradient' across its thickness. The inner cover layer has a thickness of about 0.045 inches and the outer cover layer has a thickness of about 0.03 inches.

Figure 2A:
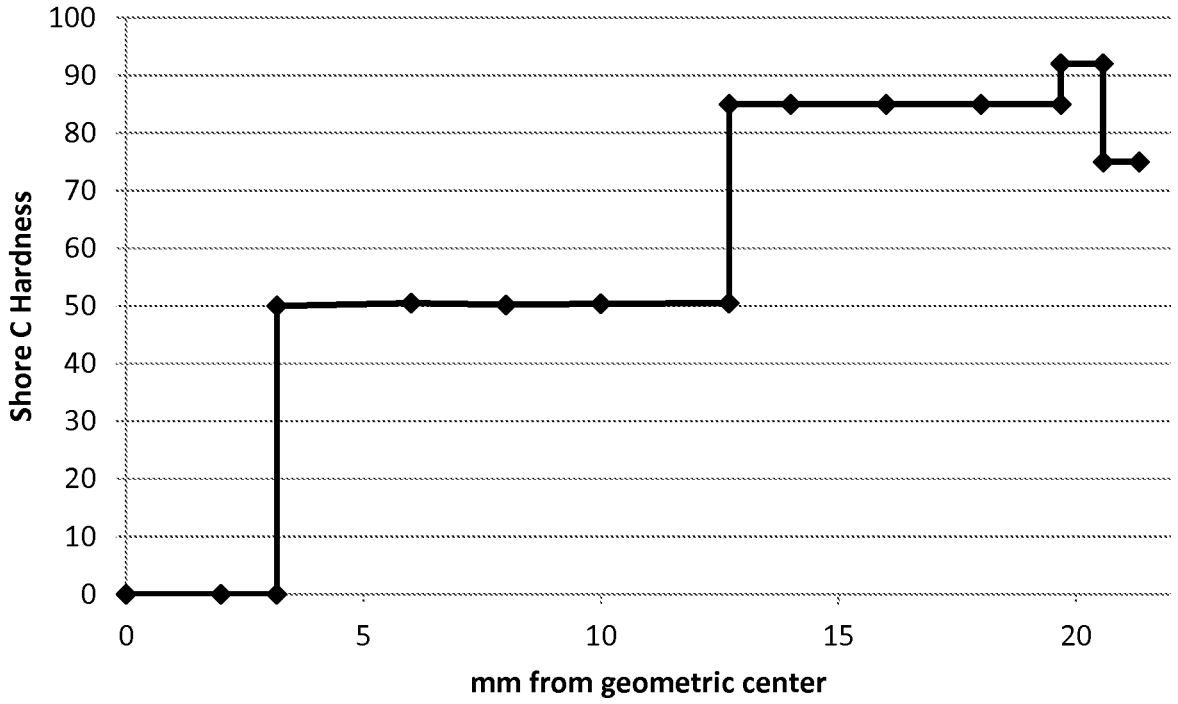
FIG. 2*a* is a plot of Shore C hardness versus distance from the center for an embodiment of a thermoplastic (TP)/thermoset (TS) hollow core golf ball.
Figure 2B:
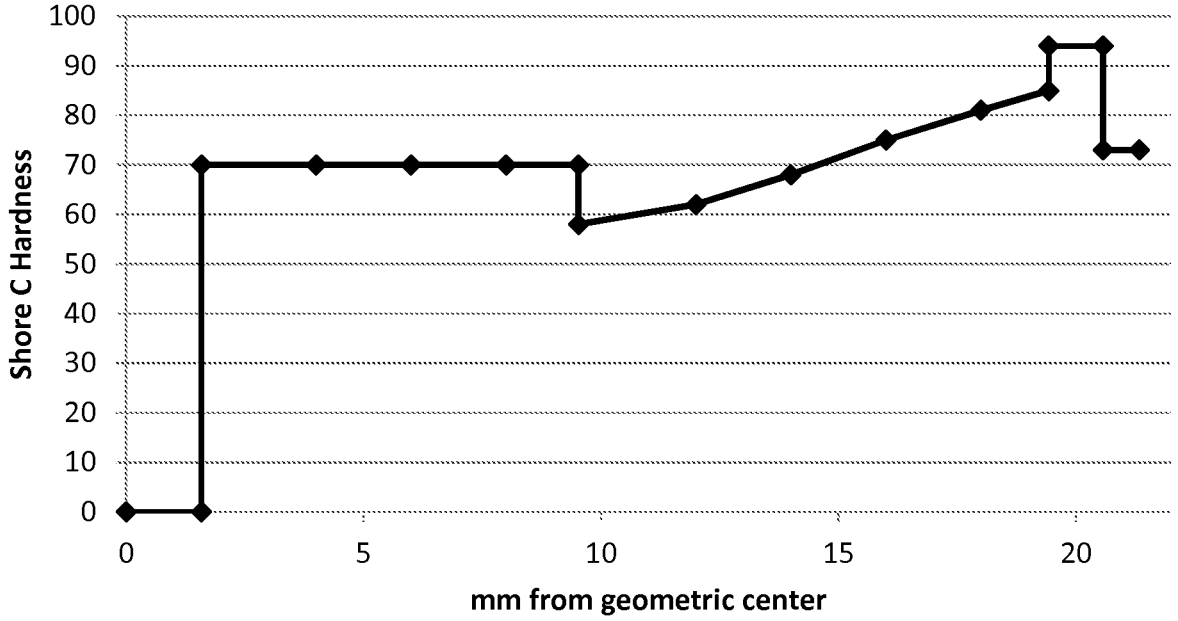
FIG. 2*b* is a plot of Shore C hardness versus distance from the center for an embodiment of a thermoplastic (TP)/thermoset (TS) hollow core golf ball.

Referring to FIGS. 2*a* and 2*b*, two different embodiments of the TP/TS hollow core golf ball are disclosed. FIG. 2*a* depicts a hardness profile for a golf ball having a hollow core, an ionomer inner cover layer, and a polyurethane outer cover layer. The thermoplastic shell layer has a thickness of about 0.375 inches and an outer diameter of about 1.0 inches, and the spherical hollow interior has a diameter of about 0.25 inches. The thermoplastic shell layer has a 'zero hardness gradient' across its thickness. The thermoset outer core layer has a thickness of about 0.275 inches and an outer diameter of about 1.55 inches. The thermoset outer core layer has a 'zero hardness gradient' across its thickness. The inner cover layer has a thickness of about 0.035 inches and the outer cover layer has a thickness of about 0.03 inches. FIG. 2*b* depicts a hardness profile for another golf ball having a hollow core, an ionomer inner cover layer, and a polyurethane outer cover layer. The thermoplastic shell layer has a thickness of about 0.3125 inches and an outer diameter of about 0.75 inches, and the spherical hollow interior has a diameter of about 0.125 inches. The thermoplastic shell layer has a 'zero hardness gradient' across its thickness. The thermoset outer core layer has a thickness of about 0.39 inches and an outer diameter of about 1.53 inches. The thermoset outer core layer has a 'positive hardness gradient' of about 27 Shore C across its thickness. The inner cover layer has a thickness of about 0.045 inches and the outer cover layer has a thickness of about 0.03 inches.

Figure 3A:
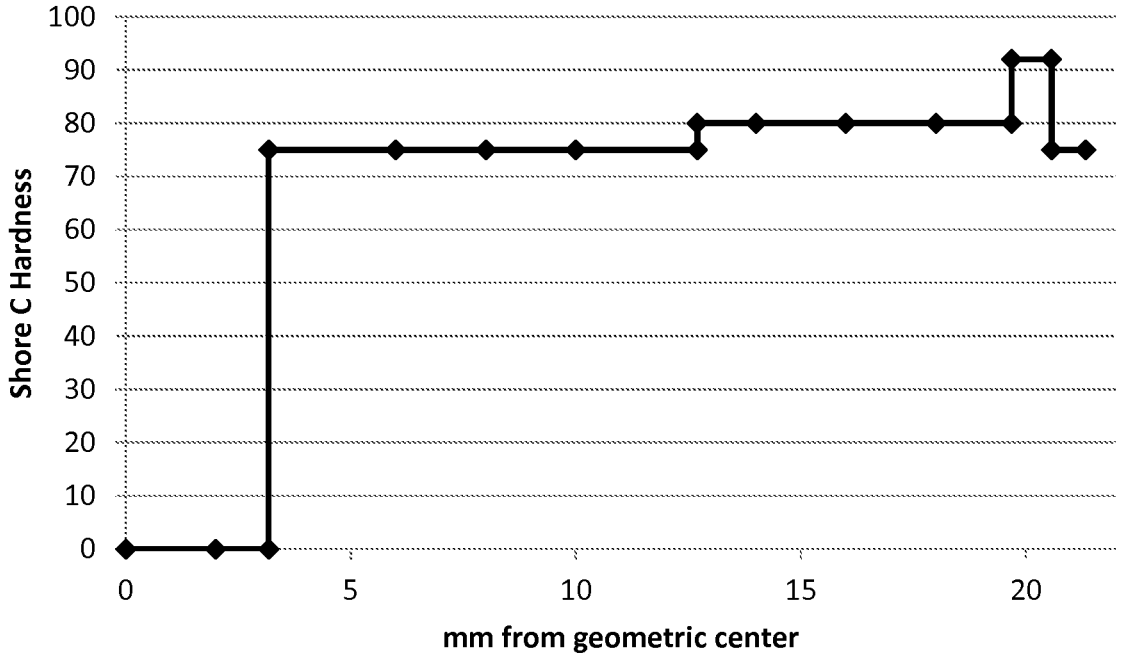
FIG. 3*a* is a plot of Shore C hardness versus distance from the center for an embodiment of a thermoplastic (TP)/thermoplastic (TP) hollow core golf ball.
Figure 3B:
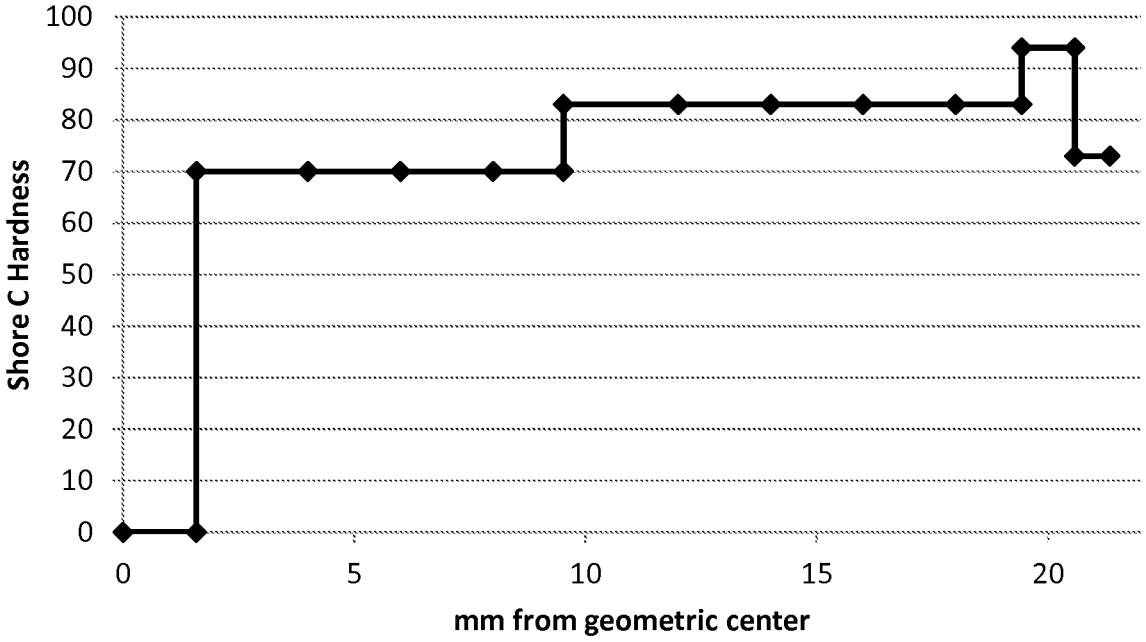
FIG. 3*b* is a plot of Shore C hardness versus distance from the center for an embodiment of a thermoplastic (TP)/thermoplastic (TP) hollow core golf ball.

Referring to FIGS. 3*a* and 3*b*, two different embodiments of the TP/TP hollow core golf ball are disclosed. FIG. 3*a* depicts a hardness profile for a golf ball having a hollow core, an ionomer inner cover layer, and a polyurethane outer cover layer. The thermoplastic shell layer has a thickness of about 0.375 inches and an outer diameter of about 1.0 inches, and the spherical hollow interior has a diameter of about 0.25 inches. The thermoplastic outer core layer has a thickness of about 0.275 inches and an outer diameter of about 1.55 inches. The inner cover layer has a thickness of about 0.035 inches and the outer cover layer has a thickness of about 0.03 inches. Both the thermoplastic shell layer and the thermoplastic outer core layer have a 'zero hardness gradient' across their respective thickness. FIG. 3*b* depicts a hardness profile for another golf ball having a hollow core, an ionomer inner cover layer, and a polyurethane outer cover layer. The thermoplastic shell layer has a thickness of about 0.3125 inches and an outer diameter of about 0.75 inches, and the spherical hollow interior has a diameter of about 0.125 inches. The thermoplastic outer core layer has a thickness of about 0.39 inches and an outer diameter of about 1.53 inches. The inner cover layer has a thickness of about 0.045 inches and the outer cover layer has a thickness of about 0.03 inches. Both the thermoplastic shell layer and the thermoplastic outer core layer have a 'zero hardness gradient' across their respective thickness.

The core optionally includes one or more intermediate core layers disposed between the shell layer and the outer core layer. The intermediate core layer can be formed from a thermoplastic or thermoset composition which can be the same as or different from the compositions used to form the shell layer or outer core layer. In a particular embodiment, the hollow center has a diameter of about 0.51 to 1.1 inches and the shell layer is formed from a thermoset composition and has a surface hardness greater than about 55 Shore C. In another particular embodiment, the hollow center preferably has a diameter of about 0.15 to 1.1 inches; the shell layer is formed a thermoplastic composition and has an outer surface hardness greater than an inner surface hardness by about 1 to 5 Shore C to define a first hardness gradient, preferably a 'positive hardness gradient;' and the layer disposed about the shell layer is either a thermoset outer core layer or thermoset intermediate core layer, and has a second hardness gradient. In another particular embodiment, the hollow center has a diameter of about 0.15 to 1.1 inches; the shell layer is formed from a thermoplastic composition and has an outer surface hardness greater than an inner surface hardness by about 1 to 10 Shore C to define a first hardness gradient, preferably a 'positive hardness gradient;' and the outer core layer has a hardness gradient that is different from the hardness gradient of either the thermoplastic shell layer or the intermediate layer, if present. In another particular embodiment, the hollow center has a diameter of from 0.15 to 1.1 inches; the shell layer is formed from a thermoset composition and has an outer surface hardness greater than an inner surface hardness by about 10 to 25 Shore C to define a first hardness gradient, preferably a 'positive hardness gradient;' the outer core layer is formed from a thermoset composition and has a hardness gradient that is different from the hardness gradient of the shell layer or the intermediate layer; a thermoplastic or thermoset intermediate core layer is disposed between the shell layer and the outer core layer.

The hollow core of the present invention is covered by at least one cover layer. An intermediate layer, such as an inner cover layer, may optionally be disposed about the hollow core, with the cover layer formed around the intermediate layer as an outer cover layer. While any of the thermoplastic materials disclosed herein may be suitable for the inner or outer cover layers of the invention, in a preferred embodiment the outermost cover is formed from a castable polyurea or a castable polyurethane; castable hybrid poly(urethane/urea); and castable hybrid poly(urea/urethane). Suitable polyurethanes include those disclosed in U.S. Pat. Nos. 5,334,673 and 6,506,851. Suitable polyureas include those disclosed in U.S. Pat. Nos. 5,484,870 and 6,835,794. These patents are incorporated herein by reference thereto.

Other suitable polyurethane compositions comprise a reaction product of at least one polyisocyanate and at least one curing agent. The curing agent can include, for example, one or more polyamines, one or more polyols, or a combination thereof. The polyisocyanate can be combined with one or more polyols to form a prepolymer, which is then combined with the at least one curing agent. Thus, the polyols described herein are suitable for use in one or both components of the polyurethane material, i.e., as part of a prepolymer and in the curing agent. More suitable polyurethanes are described in U.S. Pat. No. 7,331,878, which is incorporated by reference in its entirety.

Any polyisocyanate available to one of ordinary skill in the art is suitable for use according to the invention. Exemplary polyisocyanates include, but are not limited to, 4,4'-diphenylmethane diisocyanate (MDI); polymeric MDI; carbodiimide-modified liquid MDI; 4,4'-dicyclohexylmethane diisocyanate ($H_{12}$MDI); p-phenylene diisocyanate (PPDI); m-phenylene diisocyanate (MPDI); toluene diisocyanate (TDI); 3,3'-dimethyl-4,4'-biphenylene diisocyanate; isophorondiisocyanate; 1,6-hexamethylene diisocyanate (HDI); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term MDI includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer isocyanate groups. Examples of "low free monomer" diisocyanates include, but are not limited to Low Free Monomer MDI, Low Free Monomer TDI, and Low Free Monomer PPDI. The at least one polyisocyanate should have less than about 14% unreacted NCO groups. Preferably, the at least one polyisocyanate has no greater than about 8.0% NCO, more preferably no greater than about 7.8%, and most preferably no greater than about 7.5% NCO with a level of NCO of about 7.2 or 7.0, or 6.5% NCO commonly used.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol (PTMEG), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material. Suitable polyester polyols include, but are not limited to, polyethylene adipate glycol; polybutylene adipate glycol; polyethylene propylene adipate glycol; o-phthalate-1,6-hexanediol; poly(hexamethylene adipate)glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in the polyurethane composition of the invention and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2', 3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE® 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy) ethoxy]benzene; 1,3-bis-{2-[2-(2-hydroxyethoxy) ethoxy] ethoxy}benzene; 1,4-butanediol; 1,5-pentanediol; 1,6-hexanediol; resorcinol-di-(β-hydroxyethyl)ether; hydroquinone-di-(β-hydroxyethyl)ether; and mixtures thereof. Preferred hydroxy-terminated curatives include 1,3-bis(2-hydroxyethoxy)benzene; 1,3-bis-[2-(2-hydroxyethoxy) ethoxy]benzene; 1,3-bis-{2-[2-(2-hydroxyethoxy) ethoxy]ethoxy}benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the present invention, saturated polyurethanes are used to form one or more of the cover layers, preferably the outer cover layer, and may be selected from both castable thermoset and thermoplastic polyurethanes. In this embodiment, the saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, that a catalyst may be employed to promote the reaction between the curing agent and the isocyanate and polyol, or the curing agent and the prepolymer.

Additionally, polyurethane can be replaced with or blended with a polyurea material. Polyureas are distinctly different from polyurethane compositions. The polyurea-based compositions are preferably saturated in nature. The polyurea compositions may be formed from the reaction product of an isocyanate and polyamine prepolymer cross-linked with a curing agent. For example, polyurea-based compositions of the invention may be prepared from at least one isocyanate, at least one polyether amine, and at least one diol curing agent or at least one diamine curing agent.

While any of the embodiments herein may have any known dimple number and pattern, a preferred number of dimples is 252 to 456, and more preferably is 330 to 392. The dimples may comprise any width, depth, and edge angle disclosed in the prior art and the patterns may comprises multitudes of dimples having different widths, depths and edge angles. The parting line configuration of said pattern may be either a straight line or a staggered wave parting line (SWPL). Most preferably the dimple number is 330, 332, or 392 and comprises 5 to 7 dimples sizes and the parting line is a SWPL.

In any of these embodiments the single-layer core may be replaced with a 2 or more layer core wherein at least one core layer has a negative hardness gradient. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

EXAMPLES

The examples below are for illustrative purposes only, to set forth particularly suitable highly neutralized polymer compositions for forming thermoplastic core layers. In no manner is the present invention limited to the specific disclosures therein.

The following commercially available materials were used in the below examples:

- A-C® 5120 ethylene acrylic acid copolymer with an acrylic acid content of 15%,
- A-C® 5180 ethylene acrylic acid copolymer with an acrylic acid content of 20%,
- A-C® 395 high density oxidized polyethylene homopolymer, and
- A-C® 575 ethylene maleic anhydride copolymer, commercially available from Honeywell;
- CB23 high-cis neodymium-catalyzed polybutadiene rubber, commercially available from Lanxess Corporation;
- CA1700 Soya fatty acid, CA1726 linoleic acid, and CA1725 conjugated linoleic acid, commercially available from Chemical Associates;
- Century® 1107 highly purified isostearic acid mixture of branched and straight-chain C18 fatty acid, commercially available from Arizona Chemical;
- Clarix® 011370-01 ethylene acrylic acid copolymer with an acrylic acid content of 13% and
- Clarix® 011536-01 ethylene acrylic acid copolymer with an acrylic acid content of 15%, commercially available from A. Schulman Inc.;
- Elvaloy® AC 1224 ethylene-methyl acrylate copolymer with a methyl acrylate content of 24 wt %,
- Elvaloy® AC 1335 ethylene-methyl acrylate copolymer with a methyl acrylate content of 35 wt %,
- Elvaloy® AC 2116 ethylene-ethyl acrylate copolymer with an ethyl acrylate content of 16 wt %,
- Elvaloy® AC 3427 ethylene-butyl acrylate copolymer having a butyl acrylate content of 27 wt %, and
- Elvaloy® AC 34035 ethylene-butyl acrylate copolymer having a butyl acrylate content of 35 wt %, commercially available from E. I. du Pont de Nemours and Company;
- Escor® AT-320 ethylene acid terpolymer, commercially available from ExxonMobil Chemical Company;
- Exxelor® VA 1803 amorphous ethylene copolymer functionalized with maleic anhydride, commercially available from ExxonMobil Chemical Company;
- Fusabond® N525 metallocene-catalyzed polyethylene,
- Fusabond® N416 chemically modified ethylene elastomer,
- Fusabond® C190 anhydride modified ethylene vinyl acetate copolymer, and
- Fusabond® P614 functionalized polypropylene, commercially available from E. I. du Pont de Nemours and Company;
- Hytrel® 3078 very low modulus thermoplastic polyester elastomer, commercially available from E. I. du Pont de Nemours and Company;
- Kraton® FG 1901 GT linear triblock copolymer based on styrene and ethylene/butylene with a polystyrene content of 30% and
- Kraton® FG1924GT linear triblock copolymer based on styrene and ethylene/butylene with a polystyrene content of 13%, commercially available from Kraton Performance Polymers Inc.;
- Lotader® 4603, 4700 and 4720, random copolymers of ethylene, acrylic ester and maleic anhydride, commercially available from Arkema Corporation;
- Nordel® IP 4770 high molecular weight semi-crystalline EPDM rubber, commercially available from The Dow Chemical Company;
- Nucrel® 9-1, Nucrel® 599, Nucrel® 960, Nucrel® 0407, Nucrel® 0609, Nucrel® 1214, Nucrel® 2906, Nucrel® 2940, Nucrel® 30707, Nucrel® 31001, and Nucrel® AE acid copolymers, commercially available from E. I. du Pont de Nemours and Company;
- Primacor® 3150, 3330, 59801, and 59901 acid copolymers, commercially available from The Dow Chemical Company;
- Royaltuf® 498 maleic anhydride modified polyolefin based on an amorphous EPDM, commercially available from Chemtura Corporation;
- Sylfat® FA2 tall oil fatty acid, commercially available from Arizona Chemical;
- Vamac® G terpolymer of ethylene, methylacrylate and a cure site monomer, commercially available from E. I. du Pont de Nemours and Company; and
- XUS 60758.08L ethylene acrylic acid copolymer with an acrylic acid content of 13.5%, commercially available from The Dow Chemical Company.

Various compositions were melt blended using components as given in Table 3 below. The compositions were neutralized by adding a cation source in an amount sufficient to neutralize, theoretically, 110% of the acid groups present in components 1 and 3, except for example 72, in which the cation source was added in an amount sufficient to neutralize 75% of the acid groups. Magnesium hydroxide was used as the cation source, except for example 68, in which magnesium hydroxide and sodium hydroxide were used in an equivalent ratio of 4:1. In addition to components 1-3 and the cation source, example 71 contains ethyl oleate plasticizer.

The relative amounts of component 1 and component 2 used are indicated in Table 3 below, and are reported in wt %, based on the combined weight of components 1 and 2. The relative amounts of component 3 used are indicated in Table 3 below, and are reported in wt %, based on the total weight of the composition

TABLE 3

| Example | Component 1 | wt % | Component 2 | wt % | Component 3 | wt % |
|---|---|---|---|---|---|---|
| 1 | Primacor 5980I | 78 | Lotader 4603 | 22 | magnesium oleate | 41.6 |
| 2 | Primacor 5980I | 84 | Elvaloy AC 1335 | 16 | magnesium oleate | 41.6 |
| 3 | Primacor 5980I | 78 | Elvaloy AC 3427 | 22 | magnesium oleate | 41.6 |
| 4 | Primacor 5980I | 78 | Elvaloy AC 1335 | 22 | magnesium oleate | 41.6 |
| 5 | Primacor 5980I | 78 | Elvaloy AC 1224 | 22 | magnesium oleate | 41.6 |
| 6 | Primacor 5980I | 78 | Lotader 4720 | 22 | magnesium oleate | 41.6 |
| 7 | Primacor 5980I | 85 | Vamac G | 15 | magnesium oleate | 41.6 |
| 8 | Primacor 5980I | 90 | Vamac G | 10 | magnesium oleate | 41.6 |
| 8.1 | Primacor 5990I | 90 | Fusabond 614 | 10 | magnesium oleate | 41.6 |
| 9 | Primacor 5980I | 78 | Vamac G | 22 | magnesium oleate | 41.6 |
| 10 | Primacor 5980I | 75 | Lotader 4720 | 25 | magnesium oleate | 41.6 |
| 11 | Primacor 5980I | 55 | Elvaloy AC 3427 | 45 | magnesium oleate | 41.6 |
| 12 | Primacor 5980I | 55 | Elvaloy AC 1335 | 45 | magnesium oleate | 41.6 |
| 12.1 | Primacor 5980I | 55 | Elvaloy AC 34035 | 45 | magnesium oleate | 41.6 |
| 13 | Primacor 5980I | 55 | Elvaloy AC 2116 | 45 | magnesium oleate | 41.6 |
| 14 | Primacor 5980I | 78 | Elvaloy AC 34035 | 22 | magnesium oleate | 41.6 |
| 14.1 | Primacor 5990I | 80 | Elvaloy AC 34035 | 20 | magnesium oleate | 41.6 |
| 15 | Primacor 5980I | 34 | Elvaloy AC 34035 | 66 | magnesium oleate | 41.6 |
| 16 | Primacor 5980I | 58 | Vamac G | 42 | magnesium oleate | 41.6 |
| 17 | Primacor 5990I | 80 | Fusabond 416 | 20 | magnesium oleate | 41.6 |
| 18 | Primacor 5980I | 100 | — | — | magnesium oleate | 41.6 |
| 19 | Primacor 5980I | 78 | Fusabond 416 | 22 | magnesium oleate | 41.6 |
| 20 | Primacor 5990I | 100 | — | — | magnesium oleate | 41.6 |
| 21 | Primacor 5990I | 20 | Fusabond 416 | 80 | magnesium oleate | 41.6 |
| 21.1 | Primacor 5990I | 20 | Fusabond 416 | 80 | magnesium oleate | 31.2 |
| 21.2 | Primacor 5990I | 20 | Fusabond 416 | 80 | magnesium oleate | 20.8 |
| 22 | Clarix 011370 | 30.7 | Fusabond 416 | 69.3 | magnesium oleate | 41.6 |
| 23 | Primacor 5990I | 20 | Royaltuf 498 | 80 | magnesium oleate | 41.6 |
| 24 | Primacor 5990I | 80 | Royaltuf 498 | 20 | magnesium oleate | 41.6 |
| 25 | Primacor 5990I | 80 | Kraton FG1924GT | 20 | magnesium oleate | 41.6 |
| 26 | Primacor 5990I | 20 | Kraton FG1924GT | 80 | magnesium oleate | 41.6 |
| 27 | Nucrel 30707 | 57 | Fusabond 416 | 43 | magnesium oleate | 41.6 |
| 28 | Primacor 5990I | 80 | Hytrel 3078 | 20 | magnesium oleate | 41.6 |
| 29 | Primacor 5990I | 20 | Hytrel 3078 | 80 | magnesium oleate | 41.6 |
| 30 | Primacor 5980I | 26.8 | Elvaloy AC 34035 | 73.2 | magnesium oleate | 41.6 |
| 31 | Primacor 5980I | 26.8 | Lotader 4603 | 73.2 | magnesium oleate | 41.6 |
| 32 | Primacor 5980I | 26.8 | Elvaloy AC 2116 | 73.2 | magnesium oleate | 41.6 |
| 33 | Escor AT-320 | 30 | Elvaloy AC 34035 | 52 | magnesium oleate | 41.6 |
| | Primacor 5980I | 18 | | | | |
| 34 | Nucrel 30707 | 78.5 | Elvaloy AC 34035 | 21.5 | magnesium oleate | 41.6 |
| 35 | Nucrel 30707 | 78.5 | Fusabond 416 | 21.5 | magnesium oleate | 41.6 |
| 36 | Primacor 5980I | 26.8 | Fusabond 416 | 73.2 | magnesium oleate | 41.6 |
| 37 | Primacor 5980I | 19.5 | Fusabond N525 | 80.5 | magnesium oleate | 41.6 |
| 38 | Clarix 011536-01 | 26.5 | Fusabond N525 | 73.5 | magnesium oleate | 41.6 |
| 39 | Clarix 011370-01 | 31 | Fusabond N525 | 69 | magnesium oleate | 41.6 |
| 39.1 | XUS 60758.08L | 29.5 | Fusabond N525 | 70.5 | magnesium oleate | 41.6 |
| 40 | Nucrel 31001 | 42.5 | Fusabond N525 | 57.5 | magnesium oleate | 41.6 |
| 41 | Nucrel 30707 | 57.5 | Fusabond N525 | 42.5 | magnesium oleate | 41.6 |
| 42 | Escor AT-320 | 66.5 | Fusabond N525 | 33.5 | magnesium oleate | 41.6 |
| 43 | Nucrel 2906/2940 | 21 | Fusabond N525 | 79 | magnesium oleate | 41.6 |
| 44 | Nucrel 960 | 26.5 | Fusabond N525 | 73.5 | magnesium oleate | 41.6 |
| 45 | Nucrel 1214 | 33 | Fusabond N525 | 67 | magnesium oleate | 41.6 |
| 46 | Nucrel 599 | 40 | Fusabond N525 | 60 | magnesium oleate | 41.6 |
| 47 | Nucrel 9-1 | 44.5 | Fusabond N525 | 55.5 | magnesium oleate | 41.6 |
| 48 | Nucrel 0609 | 67 | Fusabond N525 | 33 | magnesium oleate | 41.6 |
| 49 | Nucrel 0407 | 100 | — | — | magnesium oleate | 41.6 |
| 50 | Primacor 5980I | 90 | Fusabond N525 | 10 | magnesium oleate | 41.6 |
| 51 | Primacor 5980I | 80 | Fusabond N525 | 20 | magnesium oleate | 41.6 |
| 52 | Primacor 5980I | 70 | Fusabond N525 | 30 | magnesium oleate | 41.6 |
| 53 | Primacor 5980I | 60 | Fusabond N525 | 40 | magnesium oleate | 41.6 |
| 54 | Primacor 5980I | 50 | Fusabond N525 | 50 | magnesium oleate | 41.6 |
| 55 | Primacor 5980I | 40 | Fusabond N525 | 60 | magnesium oleate | 41.6 |
| 56 | Primacor 5980I | 30 | Fusabond N525 | 70 | magnesium oleate | 41.6 |
| 57 | Primacor 5980I | 20 | Fusabond N525 | 80 | magnesium oleate | 41.6 |
| 58 | Primacor 5980I | 10 | Fusabond N525 | 90 | magnesium oleate | 41.6 |
| 59 | — | — | Fusabond N525 | 100 | magnesium oleate | 41.6 |
| 60 | Nucrel 0609 | 40 | Fusabond N525 | 20 | magnesium oleate | 41.6 |
| | Nucrel 0407 | 40 | | | | |
| 61 | Nucrel AE | 100 | — | — | magnesium oleate | 41.6 |
| 62 | Primacor 5980I | 30 | Fusabond N525 | 70 | CA1700 soya fatty acid magnesium salt | 41.6 |
| 63 | Primacor 5980I | 30 | Fusabond N525 | 70 | CA1726 linoleic acid magnesium salt | 41.6 |
| 64 | Primacor 5980I | 30 | Fusabond N525 | 70 | CA1725 conjugated linoleic acid magnesium salt | 41.6 |

TABLE 3-continued

| Example | Component 1 | wt % | Component 2 | wt % | Component 3 | wt % |
|---|---|---|---|---|---|---|
| 65 | Primacor 5980I | 30 | Fusabond N525 | 70 | Century 1107 isostearic acid magnesium salt | 41.6 |
| 66 | A-C 5120 | 73.3 | Lotader 4700 | 26.7 | oleic acid magnesium salt | 41.6 |
| 67 | A-C 5120 | 73.3 | Elvaloy 34035 | 26.7 | oleic acid magnesium salt | 41.6 |
| 68 | Primacor 5980I | 78.3 | Lotader 4700 | 21.7 | oleic acid magnesium salt and sodium salt | 41.6 |
| 69 | Primacor 5980I<br>A-C 5180 | 47<br>40 | Elvaloy AC34035 | 13 | — | — |
| 70 | Primacor 5980I | 30 | Fusabond N525 | 70 | Sylfat FA2 magnesium salt | 41.6 |
| 71 | Primacor 5980I | 30 | Fusabond N525 | 70 | oleic acid magnesium salt<br>ethyl oleate | 31.2<br>10 |
| 72 | Primacor 5980I | 80 | Fusabond N525 | 20 | sebacic acid magnesium salt | 41.6 |
| 73 | Primacor 5980I<br>A-C 5180 | 60<br>40 | — | — | — | — |
| 74 | Primacor 5980I<br>A-C 575 | 78.3<br>21.7 | — | — | oleic acid magnesium salt | 41.6 |
| 75 | Primacor 5980I | 78.3 | Exxelor VA 1803 | 21.7 | oleic acid magnesium salt | 41.6 |
| 76 | Primacor 5980I | 78.3 | A-C 395 | 21.7 | oleic acid magnesium salt | 41.6 |
| 77 | Primacor 5980I | 78.3 | Fusabond C190 | 21.7 | oleic acid magnesium salt | 41.6 |
| 78 | Primacor 5980I | 30 | Kraton FG 1901 | 70 | oleic acid magnesium salt | 41.6 |
| 79 | Primacor 5980I | 30 | Royaltuf 498 | 70 | oleic acid magnesium salt | 41.6 |
| 80 | A-C 5120 | 40 | Fusabond N525 | 60 | oleic acid magnesium salt | 41.6 |
| 81 | Primacor 5980I | 30 | Fusabond N525 | 70 | erucic acid magnesium salt | 41.6 |
| 82 | Primacor 5980I | 30 | CB23 | 70 | oleic acid magnesium salt | 41.6 |
| 83 | Primacor 5980I | 30 | Nordel IP 4770 | 70 | oleic acid magnesium salt | 41.6 |
| 84 | Primacor 5980I<br>A-C 5180 | 48<br>32 | Fusabond N525 | 20 | oleic acid magnesium salt | 41.6 |
| 85 | Nucrel 2806 | 22.2 | Fusabond N525 | 77.8 | oleic acid magnesium salt | 41.6 |
| 86 | Primacor 3330 | 61.5 | Fusabond N525 | 38.5 | oleic acid magnesium salt | 41.6 |
| 87 | Primacor 3330<br>Primacor 3150 | 45.5<br>34.5 | Fusabond N525 | 20 | oleic acid magnesium salt | 41.6 |
| 88 | Primacor 3330<br>Primacor 3150 | 28.5<br>71.5 | — | — | oleic acid magnesium salt | 41.6 |
| 89 | Primacor 3150 | 67 | Fusabond N525 | 33 | oleic acid magnesium salt | 41.6 |
| 90 | Primacor 5980I | 55 | Elvaloy AC 34035 | 45 | oleic acid magnesium salt<br>ethyl oleate | 31.2<br>10 |

Solid spheres of each composition were injection molded, and the solid sphere COR, compression, Shore D hardness, and Shore C hardness of the resulting spheres were measured after two weeks. The results are reported in Table 4 below. The surface hardness of a sphere is obtained from the average of a number of measurements taken from opposing hemispheres, taking care to avoid making measurements on the parting line of the sphere or on surface defects, such as holes or protrusions. Hardness measurements are made pursuant to ASTM D-2240 "Indentation Hardness of Rubber and Plastic by Means of a Durometer." Because of the curved surface, care must be taken to insure that the sphere is centered under the durometer indentor before a surface hardness reading is obtained. A calibrated, digital durometer, capable of reading to 0.1 hardness units is used for all hardness measurements and is set to record the maximum hardness reading obtained for each measurement. The digital durometer must be attached to, and its foot made parallel to, the base of an automatic stand. The weight on the durometer and attack rate conform to ASTM D-2240.

TABLE 4

| Ex. | Solid Sphere COR | Solid Sphere Compression | Solid Sphere Shore D | Solid Sphere Shore C |
|---|---|---|---|---|
| 1 | 0.845 | 120 | 59.6 | 89.2 |
| 2 | * | * | * | * |
| 3 | 0.871 | 117 | 57.7 | 88.6 |
| 4 | 0.867 | 122 | 63.7 | 90.6 |
| 5 | 0.866 | 119 | 62.8 | 89.9 |
| 6 | * | * | * | * |
| 7 | * | * | * | * |

TABLE 4-continued

| Ex. | Solid Sphere COR | Solid Sphere Compression | Solid Sphere Shore D | Solid Sphere Shore C |
|---|---|---|---|---|
| 8 | * | * | * | * |
| 8.1 | 0.869 | 127 | 65.3 | 92.9 |
| 9 | * | * | * | * |
| 10 | * | * | * | * |
| 11 | * | * | * | * |
| 12 | 0.856 | 101 | 55.7 | 82.4 |
| 12.1 | 0.857 | 105 | 53.2 | 81.3 |
| 13 | * | * | * | * |
| 14 | 0.873 | 122 | 64.0 | 91.1 |
| 14.1 | * | * | * | * |
| 15 | * | * | * | * |
| 16 | * | * | * | * |
| 17 | 0.878 | 117 | 60.1 | 89.4 |
| 18 | 0.853 | 135 | 67.6 | 94.9 |
| 19 | * | * | * | * |
| 20 | 0.857 | 131 | 66.2 | 94.4 |
| 21 | 0.752 | 26 | 34.8 | 57.1 |
| 21.1 | 0.729 | 9 | 34.3 | 56.3 |
| 21.2 | 0.720 | 2 | 33.8 | 55.2 |
| 22 | * | * | * | * |
| 23 | * | * | * | * |
| 24 | * | * | * | * |
| 25 | * | * | * | * |
| 26 | * | * | * | * |
| 27 | * | * | * | * |
| 28 | * | * | * | * |
| 29 | * | * | * | * |
| 30 | ** | 66 | 42.7 | 65.5 |
| 31 | 0.730 | 67 | 45.6 | 68.8 |
| 32 | ** | 100 | 52.4 | 78.2 |
| 33 | 0.760 | 64 | 43.6 | 64.5 |
| 34 | 0.814 | 91 | 52.8 | 80.4 |
| 35 | * | * | * | * |
| 36 | * | * | * | * |
| 37 | * | * | * | * |
| 38 | * | * | * | * |
| 39 | * | * | * | * |
| 39.1 | * | * | * | * |
| 40 | * | * | * | * |
| 41 | * | * | * | * |
| 42 | * | * | * | * |
| 43 | * | * | * | * |
| 44 | * | * | * | * |
| 45 | * | * | * | * |
| 46 | * | * | * | * |
| 47 | * | * | * | * |
| 48 | * | * | * | * |
| 49 | * | * | * | * |
| 50 | * | * | * | * |
| 51 | 0.873 | 121 | 61.5 | 90.2 |
| 52 | 0.870 | 116 | 60.4 | 88.2 |
| 53 | 0.865 | 107 | 57.7 | 84.4 |
| 54 | 0.853 | 97 | 53.9 | 80.2 |
| 55 | 0.837 | 82 | 50.1 | 75.5 |
| 56 | 0.818 | 66 | 45.6 | 70.7 |
| 57 | 0.787 | 45 | 41.3 | 64.7 |
| 58 | 0.768 | 26 | 35.9 | 57.3 |
| 59 | * | * | * | * |
| 60 | * | * | * | * |
| 61 | * | * | * | * |
| 62 | * | * | * | * |
| 63 | * | * | * | * |
| 64 | * | * | * | * |
| 65 | * | * | * | * |
| 66 | * | * | * | * |
| 67 | * | * | * | * |
| 68 | * | * | * | * |
| 69 | * | * | * | * |
| 70 | * | * | * | * |
| 71 | * | * | * | * |
| 72 | * | * | * | * |
| 73 | * | * | * | * |
| 74 | * | * | * | * |
| 75 | * | * | * | * |
| 76 | * | * | * | * |
| 77 | * | * | * | * |
| 78 | * | * | * | * |

TABLE 4-continued

| Ex. | Solid Sphere COR | Solid Sphere Compression | Solid Sphere Shore D | Solid Sphere Shore C |
|---|---|---|---|---|
| 79 | * | * | * | * |
| 80 | * | * | * | * |
| 81 | * | * | * | * |
| 82 | * | * | * | * |
| 83 | * | * | * | * |
| 84 | * | * | * | * |
| 85 | * | * | * | * |
| 86 | * | * | * | * |
| 87 | * | * | * | * |
| 88 | * | * | * | * |
| 89 | * | * | * | * |
| 90 | * | * | * | * |

* not measured

** sphere broke during measurement

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising a core and a cover, the core comprising:

a spherical shell layer enclosing a spherical hollow interior portion, the shell layer being formed from a thermoset rubber composition and having an outer surface and an inner surface; and an outer core layer formed from a thermoplastic composition;

wherein the hollow interior portion enclosed by the shell layer has a diameter of from 0.5 inches to 1.1 inches, the shell layer has a thickness of from 0.125 inches to 0.4 inches, and the difference in Shore C surface hardness between the outer surface of the shell layer and the inner surface of the shell layer is from 3 Shore C to 25 Shore C;

wherein the volume of the hollow interior portion enclosed by the shell layer is from 5% to 30% of the total golf ball volume; and wherein the thermoplastic composition of the outer core layer is a highly neutralized polymer composition having a solid sphere Atti compression of 50 or less and comprising:

an acid copolymer of ethylene and an $\alpha,\beta$-unsaturated carboxylic acid, optionally including a softening monomer selected from the group consisting of alkyl acrylates and methacrylates;

a non-acid polymer selected from the group consisting of ethylene-alkyl acrylate rubber and ethylene-alkyl methacrylate rubber, present in an amount of from 15 wt % to 50 wt %, based on the combined weight of the acid copolymer and the non-acid polymer;

an organic acid or salt thereof; and a cation source present in an amount sufficient to neutralize greater than 80% of all acid groups present in the composition.

2. The golf ball of claim 1, wherein the acid copolymer of ethylene and an α,β-unsaturated carboxylic acid does not include a softening monomer, and the organic acid salt is magnesium oleate present in an amount of 20 parts or greater per 100 parts of acid copolymer and non-acid copolymer combined.

3. The golf ball of claim 1, wherein the cation source is present in an amount sufficient to neutralize 110% or greater of all acid groups present in the composition.

* * * * *